US006608444B2

(12) United States Patent
Minamihata et al.

(10) Patent No.: US 6,608,444 B2
(45) Date of Patent: Aug. 19, 2003

(54) MERCURY-FREE HIGH-INTENSITY DISCHARGE LAMP OPERATING APPARATUS AND MERCURY-FREE METAL HALIDE LAMP

(75) Inventors: Ryo Minamihata, Hyogo (JP); Kiyoshi Takahashi, Osaka (JP); Yuriko Kaneko, Nara (JP); Mamoru Takeda, Kyoto (JP); Hideaki Kiryu, Osaka (JP); Takayuki Murase, Osaka (JP); Masato Yoshida, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 202 days.

(21) Appl. No.: 09/865,842

(22) Filed: May 25, 2001

(65) Prior Publication Data

US 2002/0017848 A1 Feb. 14, 2002

(30) Foreign Application Priority Data

May 26, 2000 (JP) ..... 2000-156308
Jul. 26, 2000 (JP) ..... 2000-225013

(51) Int. Cl.[7] ..... H01J 13/46; H01J 17/04

(52) U.S. Cl. ..... 315/56; 315/58; 315/82; 315/248; 315/246; 313/620; 313/623; 313/625

(58) Field of Search ..... 315/56, 77, 246, 315/82, 248, 58; 313/625, 624, 623, 626, 621, 620, 637, 634, 638, 639–642

(56) References Cited

U.S. PATENT DOCUMENTS 6,069,456 A 5/2000 Fromm et al. ..... 315/248
6,222,320 B1 4/2001 Stockwald ..... 315/48
6,353,289 B1 * 3/2002 Ishigami et al. ..... 313/637
6,483,241 B1 * 11/2002 Stockwald ..... 313/638

FOREIGN PATENT DOCUMENTS

EP 0 324 652 A1 7/1989
EP 0 883 160 A1 12/1998

(List continued on next page.)

OTHER PUBLICATIONS

Database WPI, Section Ch, Week 200027; Derwent Publications Ltd.; London, GB; Class L03; AN 1999–508953; XP002180219.

U.S. patent application Ser. No. 09/739,974, filed Jun. 28, 2001, Takahashi et al.

*Primary Examiner*—Don Wong
*Assistant Examiner*—Tuyet T. Vo
(74) *Attorney, Agent, or Firm*—Harness, Dickey & Pierce, P.L.C.

(57) ABSTRACT

A mercury-free high-intensity discharge lamp operating apparatus includes a horizontally operated high-intensity discharge lamp including an arc tube in which a luminous material is enclosed and a pair of electrodes are arranged in the arc tube; a ballast including an alternating current generation means for supplying alternating current to the pair of electrodes; and a magnetic field application means for applying in substantially vertical direction a magnetic field having a component that is substantially perpendicular to a straight line connecting heads of the pair of electrodes; wherein mercury is not included as the luminous material in the arc tube. The present invention satisfies the relationship $$0<(100BW/f)-P_0d<100$$

wherein B(mT) is the magnetic field applied to a center between the heads of the pair of electrodes, d(mm) is a distance between the heads of the pair of electrodes, $P_0$(MPa) is a pressure inside the arc tube during steady-state operation, W(W) is a power consumed during steady-state operation, and f(Hz) is a steady-state frequency during steady-state operation.

20 Claims, 27 Drawing Sheets

FOREIGN PATENT DOCUMENTS

| | | | |
|---|---|---|---|
| EP | 0 903 770 | A2 | 3/1999 |
| EP | 0 940 841 | A2 | 9/1999 |
| EP | 0 942 454 | A2 | 9/1999 |
| EP | 1 003 204 | A2 | 5/2000 |
| EP | 1 011 126 | A2 | 6/2000 |
| EP | 1 032 010 | A1 | 8/2000 |
| EP | 1 037 257 | A2 | 9/2000 |
| EP | 1 037 258 | A1 | 9/2000 |
| EP | 1 063 681 | A2 | 12/2000 |
| EP | 1 076 353 | A1 | 2/2001 |
| EP | 1 111 653 | A1 | 6/2001 |
| JP | 55086062 | A | 6/1980 |
| JP | 1-215639 | | 8/1989 |
| JP | 09161725 | A | 6/1997 |
| JP | 11-86795 | | 3/1999 |
| JP | WO99/43020 | | 8/1999 |
| JP | 11-238488 | | 8/1999 |
| JP | 11-307048 | | 11/1999 |
| JP | 11-312495 | | 11/1999 |
| JP | 11-317103 | | 11/1999 |
| JP | 2000012251 | A | 1/2000 |
| JP | 2000-90880 | | 3/2000 |
| JP | 2000-182564 | | 6/2000 |
| JP | 2001-76670 | | 3/2001 |
| WO | WO 92/08240 | | 5/1992 |
| WO | WO99/05699 | | 2/1999 |
| WO | WO00/16360 | | 3/2000 |

* cited by examiner

MERCURY-FREE HIGH-INTENSITY DISCHARGE LAMP OPERATING APPARATUS AND MERCURY-FREE METAL HALIDE LAMP

BACKGROUND OF THE INVENTION

The present invention relates to a mercury-free high-intensity discharge lamp operating apparatus and a mercury-free metal halide lamp that do not contain mercury as the luminous material.

In recent years, high-intensity discharge lamps for general lighting, projectors and vehicle headlights are being used. High-intensity discharge lamps have advantages of high efficiency, low power consumption, and brightness, compared with halogen lamps, so that the high-intensity discharge lamps are expected to be widely used. One of the high-intensity discharge lamps that are expected to be widely used is a metal halide lamp. FIG. 1 shows a cross sectional configuration of a metal halide lamp.

The metal halide lamp shown in FIG. 1 includes an arc tube (luminous bulb) 1 made of quartz glass and sealing portions 2 that are positioned at both ends of the arc tube 1 and seal the arc tube 1. A pair of electrodes 3 made of tungsten are provided in the arc tube 1, and a luminous material 6 including mercury and metal halide, and a rare gas (not shown) are enclosed in the arc tube 1. The pair of electrodes 3 in the arc tube 1 are connected to molybdenum foils 4 at one end, and the molybdenum foils 4 are sealed with the sealing portions 2. Lead wires 5 are connected to the other ends of the molybdenum foils 4. The lead wires 5 are to be electrically connected to a ballast (not shown).

The principle of light emission of the metal halide lamp shown in FIG. 1 will be described briefly. When the lamp is turned on by applying a voltage to the lead wires 5 from the ballast, a part of or the entire metal halide 6 evaporates. Then, the evaporated metal halide is dissociated to metal atoms and halogen atoms by arc discharge occurring between the pair of electrodes 3, and thus the metal atoms are excited so that light is emitted. In the vicinity of the wall of the arc tube 1, the dissociated metal atoms are recombined with the halogen atoms, and return to a metal halide. This cycle phenomenon is repeated to allow the lamp to be stably on. In general, although the metal halide has a lower vapor pressure than that of mercury, the metal halide is readily excited and emitted, so that there is a tendency that emission caused by an added metal mercury is stronger than emission caused by mercury in metal halide lamps. Therefore, mercury primarily serves as a buffering gas to determine a voltage in the arc tube 1. A rare gas in the arc tube 1 serves as a gas for starting the lamp.

In general high-intensity discharge lamps including the metal halide lamp shown in FIG. 1, the lamp is operated while the straight line connecting the pair of electrodes 3 is horizontal (hereinafter, referred to as "horizontal operation"), an arc 7 occurring between the pair of electrodes is curved upward by convection current of the vapor in the arc tube 1, as shown in FIG. 2. When the degree of curving is large and the arc 7 is attached to the wall of the arc tube 1, the temperature to the upper portion la of the arc tube 1 is locally high, so that devitrification or deformations of the upper portion 1*a* of the arc tube start comparatively in an early stage. As a result, the lifetime characteristics of the lamp are degraded.

In order to suppress the curving of the arc 7 to improve the lifetime characteristics of the lamp, there are several proposals. One of them is a technique of applying a magnetic field to a metal halide lamp to suppress the curving of the arc, which is disclosed, for example, in Japanese Laid-Open Patent Publication Nos. 55-86062 and 9-161725. The technique disclosed in Japanese Laid-open Patent Publication No. 55-86062 includes the step of disposing a strong rare earth magnet above the arc tube 1 in a metal halide lamp containing mercury in the arc tube 1 to lower the arc 7 down by utilizing repulsion (Lorentz force) between the magnet and the arc 7, thereby suppressing the curving of the arc 7. On the other hand, the technique disclosed in Japanese Laid-open Patent Publication No. 9-161725 uses an electromagnet as means for applying a magnetic field, in place of the rare earth magnet. There are other disclosures of the technique of utilizing an electromagnetic to change the position of the arc, such as Japanese Laid-Open Patent Publication No. 11-312495, 11-317103, and 2000-12251.

Nowadays, environment is an important issue, and metal halide lamps not containing mercury are desirable in view of environmental issues arising when disposing of waste. Therefore, the inventors of the present invention compared and examined mercury-free metal halide lamps and metal halide lamps containing mercury to develop mercury-free metal halide lamps.

As a result of the examination, the mercury-free metal halide lamps have significantly different characteristics than those of metal halide lamps containing mercury. For example, in a mercury-free metal halide lamp, arc curving can be suppressed by applying a magnetic field to the mercury-metal halide lamp. However, the manner in which a magnetic field is applied and the principle of suppression of curving are very different from those for the metal halide lamp containing mercury. Furthermore, depending on the intensity of the magnetic field, the arc 7 itself is unstable and a phenomenon that the arc 7 vibrates was observed. This vibration of the arc 7 is not preferable because it results in a flickering when used as a lamp.

SUMMARY OF THE INVENTION

Therefore, with the foregoing in mind, it is a main object of the present invention to provide a mercury-free high-intensity discharge lamp operating apparatus and a mercury-free metal halide lamp in which arc vibration is suppressed and flickering is prevented.

A mercury-free high-intensity discharge lamp operating apparatus of the present invention includes a horizontally operated high-intensity discharge lamp including an arc tube in which a luminous material is enclosed and a pair of electrodes are arranged in the arc tube; a ballast including an alternating current generation means for supplying alternating current to the pair of electrodes; and a magnetic field application means for applying in substantially vertical direction a magnetic field having a component that is substantially perpendicular to a straight line connecting heads of the pair of electrodes; wherein mercury is not included as the luminous material in the arc tube; and the present invention satisfies the relationship $$0<(100BW/f)-P_0d<100$$

wherein B(mT) is the magnetic field applied to a center between the heads of the pair of electrodes, d(mm) is a distance between the heads of the pair of electrodes, $P_0$(MPa) is a pressure inside the arc tube during steady-state operation, W(W) is a power consumed during steady-state operation, and f(Hz) is a steady-state frequency during steady-state operation.

A mercury-free high-intensity discharge lamp operating apparatus of the present invention includes a horizontally operated high-intensity discharge lamp including an arc tube in which a luminous material is enclosed and a pair of electrodes are arranged in the arc tube; a ballast including an alternating current generation means for supplying alternating current to the pair of electrodes; and a magnetic field application means for applying in substantially vertical direction a magnetic field having a component that is substantially perpendicular to a straight line connecting the heads of said pair of electrodes; wherein mercury is not included as the luminous material in the arc tube, and at least a rare gas is included in the arc tube; and the present invention satisfies the relationship $$0<(10BW/f)-Pd<10$$

wherein B(mT) is the magnetic field applied to a center between the heads of the pair of electrodes, d(mm) is a distance between the heads of the pair of electrodes, P(MPa) is a pressure of the enclosed rare gas at 20° C., W(W) is a power consumed during steady-state operation, and f(Hz) is a steady-state frequency during steady-state operation.

It is preferable that the pressure P of the enclosed rare gas is in the range of 0.1 (MPa)<P<2.5 (MPa).

It is preferable that the pressure P and the distance d satisfy the relationship P·d<8.

It is preferable that the pressure P and the distance d satisfy the relationship Pd≦4.6.

It is preferable that the operating frequency f during steady-state operation is in the range of 40 (Hz)<f.

It is preferable that the magnetic field B is in the range of B<500 (mT).

It is preferable that the distance d between the heads of the electrodes is in the range of 2<d(mm).

It is preferable that the high-intensity discharge lamp is a metal halide lamp including at least indium halide as the luminous material in the arc tube.

In one embodiment, the present invention further includes a reflecting mirror for reflecting light emitted by the high-intensity discharge lamp; wherein a center of an arc of the mercury-free high-intensity discharge lamp is arranged on an optical axis of the reflecting mirror.

A mercury-free metal halide lamp of the present invention includes an arc tube in which a luminous material is enclosed and a pair of electrode are arranged in the arc tube; wherein at least an indium halide serving as the luminous material and a rare gas are contained in the arc tube; and mercury is not included as the luminous material in the arc tube; and the present invention satisfies Pd≦4.6, wherein d(mm) is a distance between the heads of the pair of electrodes, and P(MPa) is a pressure of the enclosed rare gas at room temperature.

It is preferable that the pressure P of the enclosed rare gas is at least 0.3 (MPa) at room temperature.

It is preferable that the distance d is at least 2 (mm).

In one embodiment of the present invention, the metal halide lamp is operated in a perpendicular direction.

In one embodiment of the present invention, the metal halide lamp is operated in a horizontal direction; and the present invention further includes a magnetic field application means for applying a magnetic field having a component that is substantially perpendicular to a straight line connecting the heads of the pair of electrodes, thereby suppressing arc curving.

In one embodiment of the present invention, the metal halide lamp is of an alternating current lighting type where an alternating current is supplied to the pair of electrodes.

In one embodiment of the present invention, a scandium halide, a sodium halide, and a thallium halide are contained as the luminous material in the arc tube.

In one embodiment of the present invention, a halogen constituting the halides is at least one selected from the group consisting of iodine and bromine.

In one embodiment of the present invention, the rare gas is Xe (xenon).

In one embodiment of the present invention, the mercury-free metal halide lamp further includes a reflecting mirror for reflecting light emitted by the metal halide lamp; wherein a center of an arc of the mercury-free metal halide lamp is arranged on an optical axis of the reflecting mirror.

In the mercury-free high-intensity discharge lamp of the present invention, the relationship of the equation $0<(10BW/f)-P_0d<100$ is satisfied, wherein B(mT) is the magnetic field applied to the center between the heads of the pair of electrodes, d(mm) is the distance between the heads of the pair of electrodes, $P_0$(MPa) is the pressure inside the arc tube during steady-state operation, W(W) is the power consumed during steady-state operation, and f(Hz) is the steady-state frequency during steady-state operation, or the relationship of the equation 0<(10BW/f)−Pd<10 is satisfied, where P (MPa) is the pressure of the enclosed rare gas at 20° C. Thus, arc vibrations are suppressed, and flickering can be prevented.

Furthermore, the arc is not in contact with the tube wall, so that the lifetime characteristics can be excellent. More specifically, in the case where a value of $\{(100BW/f)\ P_0d\}$ or a value of {(10BW/f)−P·d} is 0 or less, the arc curves so as to be along the tube wall, and therefore the temperature in the upper portion of the arc tube is increased, and devitrification or deformations occur in the arc tube of the mercury-free high-intensity discharge lamp operating apparatus. As a result, the lifetime characteristics are degraded. The present invention allows such degradation of the lifetime characteristics to be prevented.

When a value of P·d is less than 8, an effect of reducing the start-up voltage can be obtained. More specifically, when a value of P·d is 8 or more, the start-up voltage may exceed 30 kv. A driving circuit that can generate a start-up voltage exceeding 30 kV can be large-scale. Therefore, it is preferable that the value of P·d is below 8. Furthermore, when a value of P·d is less than 6, the start-up voltage can be 25 kV or less. As the driving circuit, a circuit that is started with a start-up voltage of 25 kV or less is preferable because it can be smaller. Therefore, by setting the value of P·d at 6 or less, an effect of downsizing the circuit can be obtained. It is more preferable that the value of P·d is 4.6 or less.

When the pressure P of the enclosed gas at 20° C. is 0.1 MPa or more, an effect of improving the stability of the arc can be obtained. When the P is 0.3 MPa or more, an effect of maintaining the stability of the arc can be obtained even when no enclosed material evaporates immediately after turned on. Furthermore, when P is 0.5 Mpa or more, it is possible to facilitate thermal conduction in the arc tube, so that the time required until the temperature in the arc tube is stabilized can be reduced. Thus, the time required until the enclosed material evaporates can be reduced, so that the time required until the mercury-free high-intensity discharge lamp operating apparatus is stabilized can be shortened.

When the P is 2.5 MPa or less, an effect of effectively preventing the breakage of the arc tube can be obtained. More specifically, when the P exceeds 2.5 MPa, the pressure $P_0$ in the arc tube during operation exceeds 25 MPa, so that the arc tube can be broken more easily. Therefore, it is preferable that the P is 2.5 or less.

When P is 2.0 MPa or less, an effect of reducing the start-up voltage can be obtained. More specifically, when P exceeds 2.0 MPa, the start-up voltage at the start of operation exceeds 30 kV. The driving circuit of the mercury-free high-intensity discharge lamp that generates the start-up voltage exceeding 30 kV can be large-scale. Therefore, it is preferable that the P is 2.0 or less also in view of downsizing of the apparatus. In addition, when the start-up voltage of 30 kV or more is applied, the start-up voltage itself can be generated as large noise, thus affecting peripheral equipment. Moreover, higher insulation is required than that of an insulating material constituting the mercury-free high-intensity discharge lamp operating apparatus, which is disadvantageous in terms of the cost. Therefore, it is preferable that the P is 2.0 or less.

When the operating frequency f exceeds 40 Hz, the lifetime characteristics can be improved more effectively. When the operating frequency f is 40 Hz or less, the time during which electrons collide with an electrode on one side during polarity reversal is prolonged, so that the temperature in the heads of the electrodes is increased, so that depletion of the electrodes is facilitated.

When the magnetic field B is less than 500 mT, an effect of reducing the influence of noise with respect to lead lines and peripheral electrical equipment can be obtained. More specifically, When a magnetic field is applied to the arc, the magnetic field occurs not only in the arc, but also in the periphery. On the other hand, when the magnetic field B applied to the center of the electrodes during steady-state operation is 500 mT or more, the magnetic field applied to the periphery is increased. Therefore, noise occurs with respect to lead lines and peripheral electrical equipment, and as a result, malfunctioning can occur. Therefore, it is preferable that the magnetic field B is less than 500 mT.

When the distance d between the electrode heads exceeds 2 mm, the depletion of the electrodes can be prevented, and thus the lifetime characteristics can be improved more effectively. More specifically, when the distance d between the electrode heads is 2 mm or less, it is difficult in the mercury-free metal halide lamp not containing mercury to obtain a suitable lamp voltage (e.g., 60V or more). Therefore, the current value of the lamp is increased, and the depletion of the electrodes is facilitated. For this reason, it is preferable that the distance between the electrode heads exceeds 2 mm. Considering the manufacturing variations, it is more preferable that the distance is 3 mm or more to obtain 60V or more stably.

Furthermore, when a reflecting mirror is further provided and the center of the arc is arranged on the optical axis of the reflecting mirror, light from the arc can be projected effectively. As a result, a mercury-free high-intensity discharge lamp having good efficiency can be obtained. Furthermore, with this configuration, it is possible to realize a high-intensity discharge lamp with a controllable arc position in a simple manner.

According to a mercury-free metal halide lamp of the present invention, Pd is set to $Pd \leqq 4.6$, wherein d(mm) is the distance between the heads of the pair of electrodes and P(MPa) is the pressure of the enclosed rare gas at room temperature. Thus, the present invention makes it possible to suppress arc vibrations and prevent flickering. In other words, flickering during operation of a mercury-free meal halide lamp can be eliminated and stable arc can be obtained.

According to the present invention, the equation $0<(10BW/f)-P_0d<100$ is satisfied, wherein B(mT) is the magnetic field applied to the center between the heads of the pair of electrodes, d(mm) is the distance between the heads of the pair of electrodes, $P_0$(MPa) is the pressure inside the arc tube during steady-state operation, W(W) is the power consumed during steady-state operation, and f(Hz) is the steady-state frequency during steady-state operation. Thus, the present invention makes it possible to provide a mercury-free high-intensity discharge lamp in which arc vibrations are suppressed and flickering is prevented.

Furthermore, according to a mercury-free metal halide lamp of the present invention, Pd is set to $Pd \leqq 4.6$, wherein d(mm) is the distance between the heads of the pair of electrodes and P(MPa) is the pressure of the enclosed rare gas at room temperature. Thus, the present invention makes it possible to suppress arc vibrations and prevent flickering.

This and other advantages of the present invention will become apparent to those skilled in the art upon reading and understanding the following detailed description with reference to the accompanying figures.

DETAILED DESCRIPTION OF THE INVENTION

First, the insights obtained by the inventors of the present invention by comparing and examining conventional metal halide lamps containing mercury and mercury-free metal halide lamps not containing mercury will be explained before describing embodiments of the present invention.

The conventional metal halide lamp examined by the inventors of the present invention is a Sc—Na based metal halide lamp that is generally known as having good emission characteristics, and contains mercury (Hg), scandium iodide ($ScI_3$) and sodium iodide (NaI) as the luminous material 6. On the other hand, the mercury-free metal halide lamp contains trivalent indium iodide ($In_3$), thallium iodide (TlI), and scandium iodide ($ScI_3$), and does not contain mercury (Hg). The distance between the heads of the pair of electrodes 3 is about 4 mm, and the inner volume of the arc tube 1 is about 0.025 cc. In the arc tube 1, xenon gas with about 1.4 MPa is enclosed at room temperature.

Figure 3A:
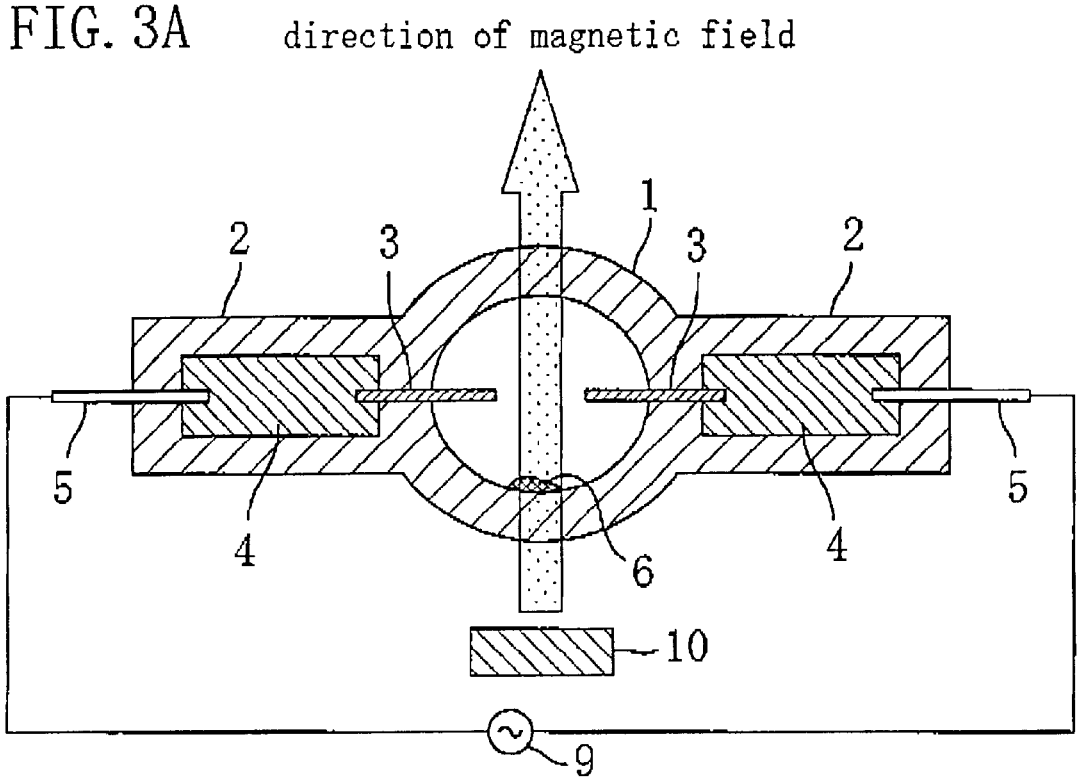
FIGS. 3A and 3B are cross-sectional view showing a configuration, in which a permanent magnet 10 is arranged below or above the arc tube 1.
Figure 3B:
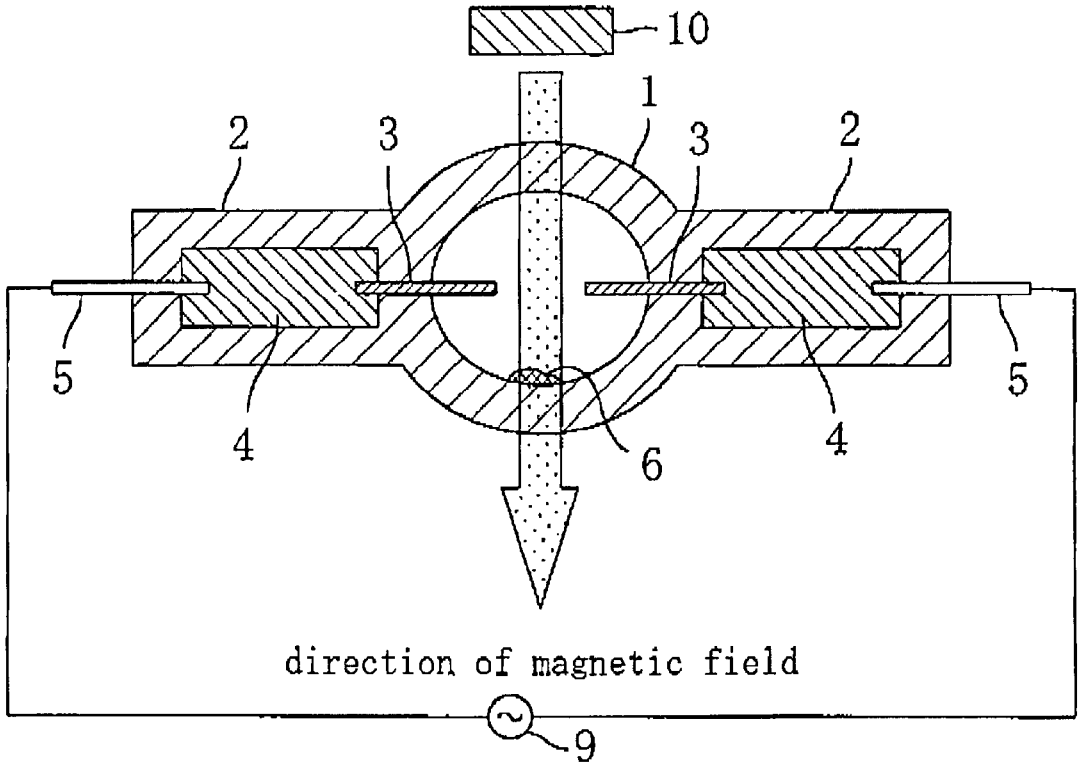

In the configuration in which the two types of lamps are operated horizontally with a rectangular wave with a frequency of 400 Hz, the magnitude of the magnetic field necessary to eliminate arc curving was examined. In addition, as shown in FIGS. 3A and 3B, the influence of the direction of the magnetic field was examined by moving the position of a ferrite permanent magnet 10. In the configuration as shown in FIG. 3A, the ferrite permanent magnet 10 is disposed below the arc tube 1, and in the configuration as shown in FIG. 3B, the ferrite permanent magnet 10 is disposed above the arc tube 1. The ferrite permanent magnet 10 applies a magnetic field to a direction perpendicular and vertical to the arc, although the directions of the magnetic fields are opposite. The results are as follows.

In conventional mercury lamps containing mercury, when the magnet 10 was disposed above (FIG. 3B), the effect of arc suppression was obtained at 0.05 T. On the other hand, when the magnet 10 was disposed below (FIG. 3A), arc curving was enlarged and any effect of arc suppression could not be obtained. On the other hand, in the case of mercury-free lamps, surprisingly, either when the magnet 10 is disposed above or below, the effect of arc suppression was obtained at 0.01 T. In both types of the lamps, the polarity was switched between the N pole and the S pole, and the effects were the same as above, and no polarity dependence was observed. Such a surprising phenomenon occurs, maybe because the mercury lamp containing mercury and the mercury-free lamp are different in the principle of suppression of arc curving. However, definite reasons have not been clear yet at present.

When focusing on the magnetic flux density necessary for arc curving suppression, the magnetic flux density was 0.05 T in the case of the mercury lamp containing mercury, whereas only 0.01 T, which is ⅕, was necessary in the case of the mercury-free lamp. This means as follows. In the mercury lamp containing mercury, a comparatively large magnetic flux density of 0.05 T is required to obtain the effect of arc curving suppression, and therefore, it is necessary to use a rare earth magnet having a strong magnetic flux density. On the other hand, in the case of the mercury-free lamp, it is possible to use a comparatively inexpensive ferrite permanent magnet to obtain the effect of arc curving suppression.

The inventors of the present invention proceed with further examination, and experimentally found that the following equation 1 (proportion relation) is satisfied between the intensity B of the magnetic field having a component of the same direction as that of arc curving, a lamp current I, the distance d between the electrodes, an operating frequency f, and the magnitude F of a force suppressing arc curving.

$$F\ (B \cdot I \cdot d)/f \qquad \text{Equation 1}$$

These insights of the inventors of the present invention are described more specifically in Japanese Patent Application No. 2000-388000 (corresponding to U.S. patent application Ser. No. 09/739,974, Assignee; Matsushita Electric Industrial Co., Ltd.), which are incorporated herein by reference.

Although it was confirmed that arc curving was suppressed by moving the curved portion of the arc downward with F shown in Equation 1, further examination showed that, depending on the conditions, the arc itself became unstable and the phenomenon that the arc vibrates was observed. The parameters that may influence the vibration of the arc may be the magnetic field B, the current I, the distance d between the electrodes, and the operating frequency f. However, the inventors of the present invention experimentally confirmed that there is no direct correlation between these parameters and the vibration of the arc. Then, the inventors of the present invention focused on the convection current, which is another factor affecting the arc.

As a result from continued studies focusing on the convection current, the inventors of the present invention found that the upward force on the arc acts in proportion to p · d. On the other hand, it was also deduced that the downward force on the arc acts in proportion with (BW/f) obtained by transforming the afore-mentioned term (B·I·d)/f. Therefore, it was ascertained that the balance between these forces changes the curving of the arc. In the following, it is explained based on what principles the upward force on the arc acts, and then the downward force on the arc is explained.

Upward Force on the Arc

In order to express the upward force on the arc due to the convection current with an equation, the following model was developed, based on the assumption that the curving of the arc 7 is caused by the upward convection current between the electrodes 3 in the arc tube 1. This model is shown in FIG. 4.

Figure 1:
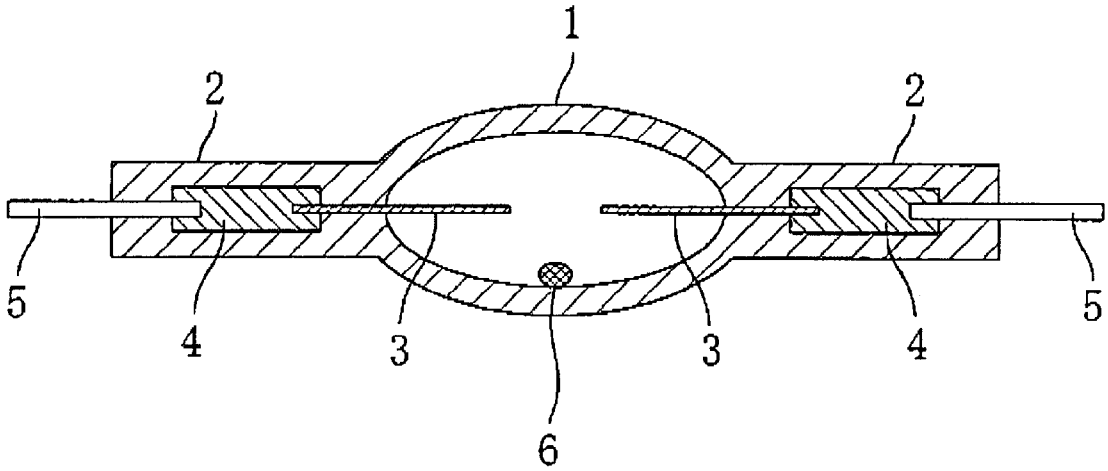
FIG. 1 is a cross-sectional view schematically showing the configuration of a metal halide lamp.
Figure 4:
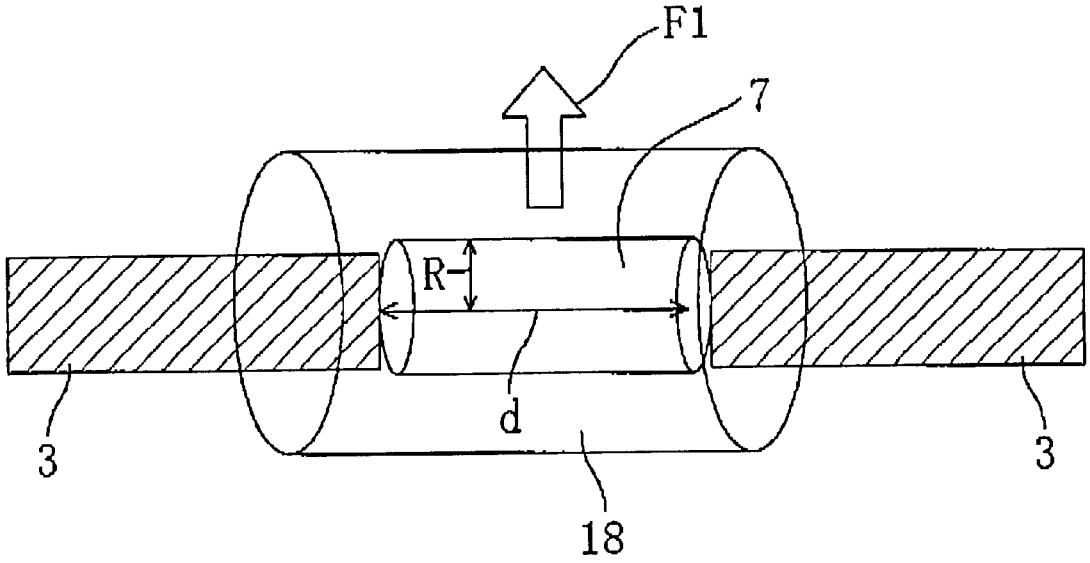
FIG. 4 is a diagram of a model of the configuration near the arc, illustrating the upward force F1 acting on the arc.

FIG. 4 shows a model of the inside of the arc tube 1 shown in FIG. 1. F1 denotes the upward force applied to the arc 7 generated between the pair of electrodes 3. A gas 8 located near the tube walls of the arc tube 1 surrounds the arc 7. When Pw is the gas density of the gas 8 near the tube walls, Pa is the gas density in the arc 7, R is the effective radius of the arc 7, g is the gravitational force, and d is the distance between the heads of the electrodes 3, then the upward force F1 due to the convection current (that is, the buoyancy F1 acting on the arc 7) can be expressed by Equation 2 below. In this model, the shape of the arc 7 and the gas 8 are regarded as cylindrical columns.

$$F1=\pi\cdot R^2\cdot d(Pw-Pa)g \qquad \text{Equation 2}$$

Then, when Ta is the gas temperature inside the arc 7, which is assumed to be uniform, Tw is the temperature of the gas 8 near the tube walls, which is assumed to be uniform, then Equation 2 can be transformed with the ideal gas equation into Equation 3 below.

$$F1=\pi\cdot R^2\cdot d\cdot Pa\cdot(Tw-Ta)/Ta\cdot g \qquad \text{Equation 3}$$

Here, Pw can be changed considerably by changing the gas pressure of the enclosed gas. On the other hand, the change of (Tw−Ta)/Ta, can be ignored, because it is small compared with the change of Pw. Thus, Equation 3 can be transformed into the following Equation 4.

$$F1\ Pa\cdot d \qquad \text{Equation 4}$$

In Equation 4, Pa can be taken to be proportional to the gas pressure P of the enclosed gas, so that Equation 4 can be rewritten as the following Equation 5.

$$F1\ P\cdot d \qquad \text{Equation 5}$$

From Equation 5, it can be seen that the upward force due to the convection current is proportional to P·d. Therefore, the curve amount of the arc is proportional to P·d.

Downward Force on the Arc

First, before explaining the downward force on the arc, the Lorentz force will be explained. If a magnetic field is applied that is vertical and perpendicular with respect to the arc 7 when the lamp is operated horizontally, then the Lorentz force acts on the arc in lateral direction (horizontal direction) according to Fleming's left hand rule. When I is the lamp current and d is the distance between the electrodes, then the Lorentz force applied in lateral direction is F (Lorentz force)=BId. Since the lamp voltage V is proportional to L, Bid is proportional to BW, so that BW BId.

The downward force on the arc (referred to as "F2" in the following) is not applied laterally on the arc but vertically downward, so that although it is not the same as the Lorentz force, it seems to be possible to transform (B·I·d)/f of Equation 1 similarly into BW/f.

Furthermore, the inventors of the present invention continued experimentally that the downward force F2 on the arc is proportional to BW/f. Based on this experimental result, it can be seen that the downward force F2 suppressing the curving of the arc can be expressed as 10BW/f. This means that the downward force suppressing the curving of the arc increases proportionally to the strength of the magnetic field B, is proportional to the power w consumed when the lamp is on, and is inversely proportional to the operating frequency f.

Figure 5:
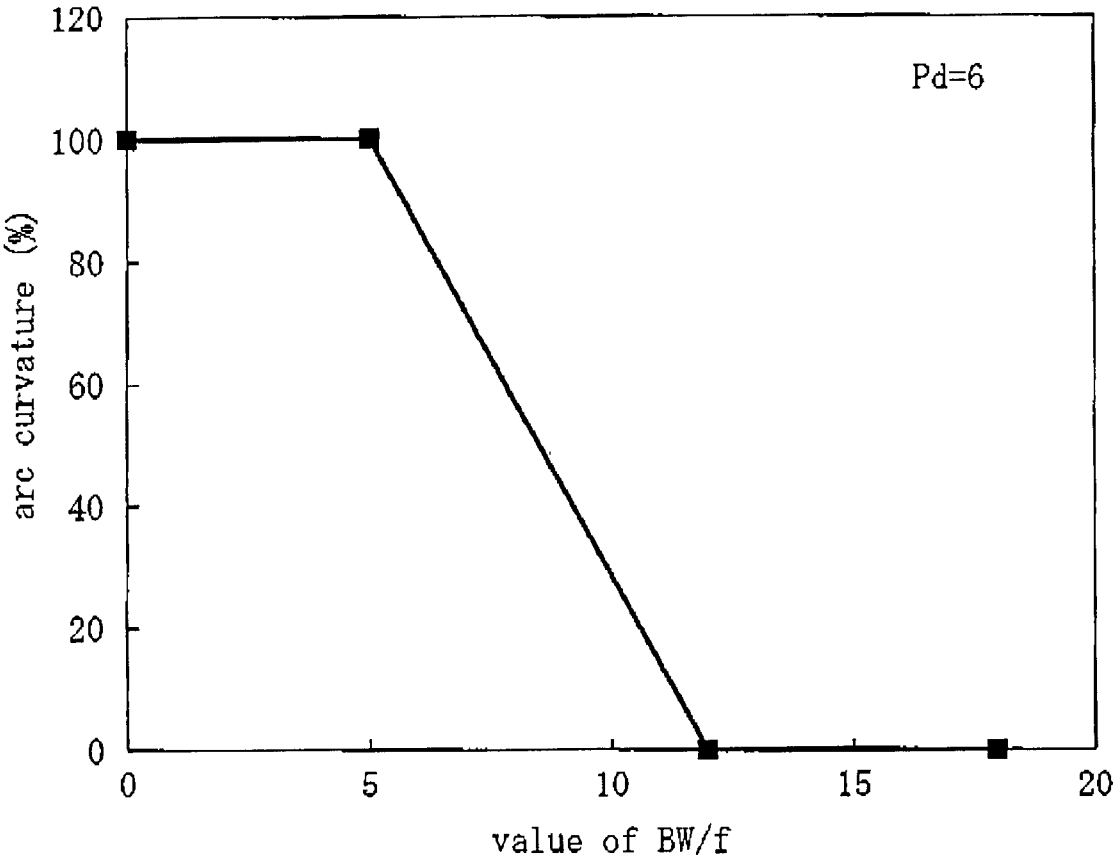
FIG. 5 is a graph illustrating the relationship between the arc curvature and BW/f.

FIG. 5 shows the relationship between the arc curvature and BW/f. The arc curvature in FIG. 5 represents the curving of the arc, marking as 100% the situation that the arc reaches the tube walls, and as 0% the situation that the arc forms a straight line. The experiment in FIG. 5 was performed with a configuration in which the value of Pd is 6, As becomes clear from FIG. 5, when the value of BW/f increases, the arc curvature decreases, and the downward force suppressing the arc curving becomes stronger. When BW/f exceeds 10, the arc curvature becomes 0% and the are becomes straight (linear).

The inventors of the present invention found that to strike a balance between the upward force F1 on the arc and the downward force F2 on the arc as described above and suppress arc vibrations, the lamp configuration is required to be as described below, thus arriving at the present invention.

When B(mT) is the magnetic field applied at the center between the heads of the two electrodes 3, d(mm) is the distance between the heads of the two electrodes 3, $P_0$(MPa) is the pressure inside the arc tube 1 during steady-state operation (operating pressure), W(W) is the power consumed during steady-state operation, and f(Hz) is the steady-state frequency during steady-state operation, then a configuration was adopted that satisfies the relationship $$0<(100BW/f)-P_0d<100 \qquad \text{Equation 6}$$

The term (100BW/f) in Equation 6 is the term of the downward force F2 on the arc, and the term Pod is the term of the upward force F1 on the arc.

The "100" in the term (100BW/f) is a factor for adjusting the dimensions, and is an experimentally determined factor. That is to say, the 100BW/f of the force F2 suppressing the curving of the arc and the $P_0$·d of the force F1 curving the arc are balanced by the factor 100 multiplied to BW/f, and (100BW/f)−$P_0$d is proportional to the curvature of the arc. Therefore, when (100BW/f)−$P_0$d becomes large, the curving of the arc becomes large, and when P·d−10BW/f becomes small, the curving of the arc becomes small.

On the other hand, since, as a rule based on experience, the pressure $P_0$(MPa) inside the arc tube 1 during steady-state operation is about 10 times the pressure P(MPa) of the enclosed rare gas in the mercury-free metal halide lamp, it is possible to transform Equation 6 into Equation 7. In this case, the factor 10 balances F1 with F2.

$$0<(10BW/f)-Pd<10 \qquad \text{Equation 7}$$

In Equation 7, the pressure P(MPa) of the enclosed rare gas at 20° C. was taken. The following is a thermodynamic explanation why the pressure $P_0$ inside the arc tube 1 becomes 10 times the pressure P. In mercury-free metal halide lamps, when the lamp is turned on, a rare gas and a metal halide gas are present in the arc tube. When the lamp is turned on, the temperature at the center portion of the arc is about 5000 to 6000K, and the temperature near the walls of the arc tube is 1000K, so that it can be assumed that the average gas temperature inside the arc tube 1 is about 3000K. A temperature of about 3000K during operation is about 10 times the room temperature of 293K, so that it follows from the ideal gas equation that the pressure is about 10 times higher. For example, when the pressure P of the enclosed rare gas is 1.0 MPa, the pressure $P_0$ during operation becomes 10 MPa. The pressure inside the arc tube 1 during operation is shown in FIG. 6.

Figure 6:
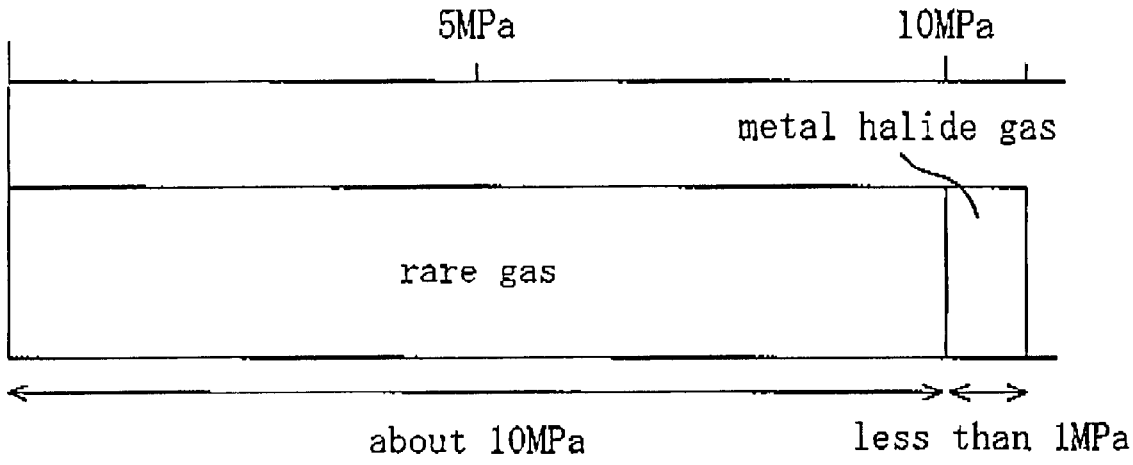
FIG. 6 is a graph illustrating the pressure inside the arc tube 1 during operation.

As shown in FIG. 6, when the pressure $P_0$of the rare gas during operation is 10 MPa, the gas pressure of the metal halide is 1 MPA, which is 1/10 of that of the rare gas. Therefore, most of the pressure is due to the rare gas, so that it is no particular problem to ignore the influence of the metal halide. Thus, in practice, a configuration Can be adopted, that is based on the pressure P of the enclosed rare gas at 20° C. In the case of mercury-containing metal halide lamps, when the overall pressure inside the arc tube 1 during operation is taken to be 100%, Bg gas accounts for about 30%, so that there is the possibility that with a configuration based on the pressure P of the enclosed rare gas at 20° C., the lamp properties during actual operation cannot be reflected. Also, in the case of mercury-free metal halide lamps, in configurations which contain a metal halide gas in amounts that cannot be ignored in comparison with the rare gas, configurations based on the pressure $P_0$ inside the arc tube 1 are preferable over configurations based on the pressure P of the enclosed rare gas at 20° C., because this reflects the properties of the lamp more accurately.

Hereinafter, preferable embodiments of the present invention will be described with reference to the accompanying drawings. For simplification, elements having substantially the same function bear the same reference numerals. The present invention is not limited to the following embodiments.

Embodiment 1

Figure 7:
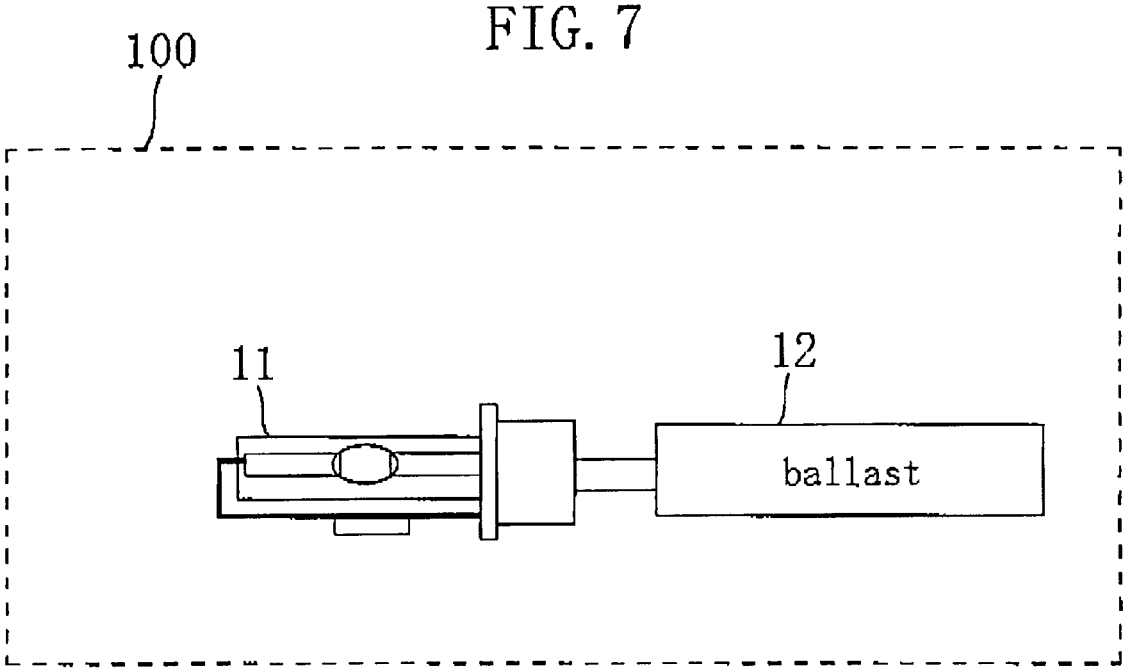
FIG. 7 is a diagram showing the configuration of a mercury-free high-intensity discharge lamp operating apparatus 100 according to Embodiment 1 of the present invention.
Figure 8:
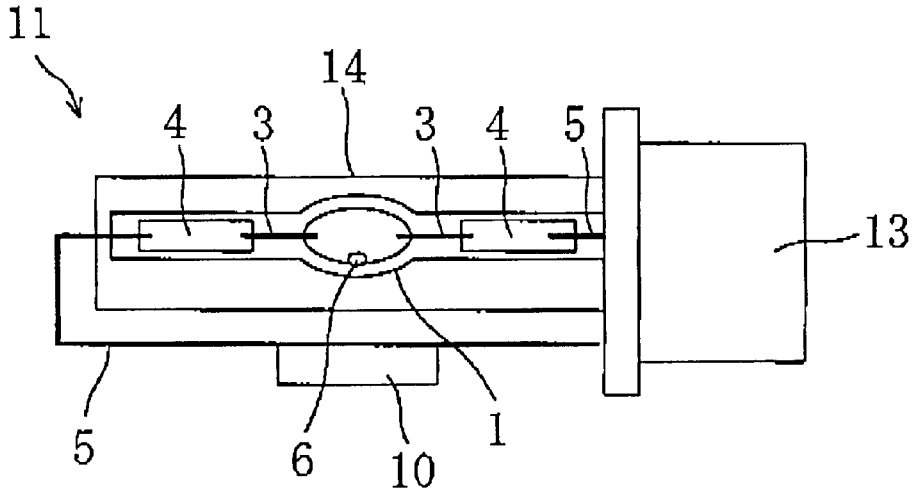
FIG. 8 is a cross-sectional view schematically showing the configuration of the high-intensity discharge lamp 11 included in the lamp operating apparatus 100.

Embodiment 1 of the present invention will be described with reference to FIGS. 7 to 15. In Embodiment 1, the properties are explained when changing mainly the magnetic field B applied to the arc. FIG. 7 schematically shows the configuration of a mercury-free high-intensity discharge lamp operating apparatus 100 according to Embodiment 1. FIG. 8 schematically shows the cross-sectional configuration of a high-intensity discharge lamp 11 included in the lamp operating apparatus 100.

As shown in FIG. 7, the lamp operating apparatus 100 according to this embodiment includes a high-intensity discharge lamp 11 and a ballast 12 for operating the lamp 11. As shown in FIG. 8, the high-intensity discharge lamp 11 includes an arc tube 1 containing luminous material 6 and a pair of electrodes 3 arranged inside the arc tube 1.

The high-intensity discharge lamp 11 according to the present embodiment is a metal halide lamp that contains no mercury (Hg) as the luminous material 6, and is operated horizontally, which means that the straight line connecting the heads of the two electrodes 3 is arranged to be substantially horizontal. The ballast 12 shown in FIG. 7 is provided with an alternating current generation means for supplying an alternating current to the pair of electrodes 3 (or to a pair of external leads 5). For the alternating current generation means, any suitable alternating current generation means as known in the art can be used. The lamp 11 is electrically connected to the ballast 12 with the axis of the pair of electrodes 3 in horizontal orientation, and the connected lamp 11 is operated at a rated power, supplying for example a square alternating current to the lamp 11.

The configuration of the ballast 12 will be described in more detail. The ballast 12 in this embodiment is designed so that the operating frequency and the operating power can be set freely. When the power is turned ON, a pulse voltage of about 20 (kV) is applied continuously between the electrodes of the lamp. This forms an arc between the electrodes of the lamp, and the lamp 11 begins to operate. When the lamp 11 begins to operate, the voltage between the electrodes decreases to several dozen Volts. At the same time, the lamp current increases. In this situation, the ballast 12 supplies a current to the lamp 11 at a pre-set frequency (for example, 50 Hz constant). Especially when the lamp 11 is used in an automobile, the light is required to be on immediately after turning on the switch, so that for the several seconds to several dozen seconds until the voltage of the lamp has stabilized, about twice the rated power is supplied. The ballast 12 has the function to adjust the lamp current according to the lamp voltage, such that at stationary lamp operation, the preset power is achieved with a square wave of a preset frequency. The ballast 12 can also have the function to change the frequency only during the initial period of the operation when the lamp power W is large. Also, in order to absorb variations in the optimum frequency among products, it is also possible that the ballast 12 has the function to provide a temporal change, for example by adjusting the operating frequency.

Next, the lamp 11 will be described more specifically. The arc tube 1 is made for example of quartz glass, and its internal volume V is about 0.025 (cc). The distance d between the heads of the pair of electrodes 3 is 4 (mm). The enclosed material 6 is a metal halide, and the enclosed material 6 does not contain mercury. At the center between the pair of electrodes in the arc tube 1, the inner radius of the arc tube 1 in a direction perpendicular to a line connecting the electrodes (referred to as "inner radius" in the following) is about 2.8 (mm). The arc tube 1 is enclosed by an outer tube 14, which is fastened to a lamp base 13.

Each of the pair of electrodes 3 is connected via a metal foil 4 sealed into a side portion of the arc tube 1 to an external lead wire 5. The lamp 11 is provided with a magnetic field application means 10 for applying in substantially vertical direction a magnetic field including a component that is substantially perpendicular to the line connecting the heads of the pair of electrodes 3. In this embodiment, a permanent magnetic is used for the magnetic field application means 10, and a permanent magnet 10 applying a magnetic field B of 4.0 (mT) to the arc is fixed to one of the external lead wires 5. At the arc portion between the pair of electrodes 3, this permanent magnet 10 forms a magnetic field whose magnetic force lines are perpendicular.

The enclosed material 6 that is enclosed into the arc tube 1 is for example trivalent indium iodide ($InI_3$), thallium iodide (TlI), scandium iodide ($ScI_3$) and sodium iodide (NaI). Although it is not shown in the drawings, xenon gas, which is a rare gas, is enclosed at 1.0 (MPa) at 20° C.

When B(mT) is the magnetic field applied at the middle between the heads of the two electrodes 3, d(mm) is the distance between the heads of the two electrodes 3, $P_0$(MPa) is the pressure inside the arc tube 1 during steady-state operation (operating pressure), w(w) is the power consumed during steady-state operation, and f(Hz) is the steady-state frequency during steady-state operation, then the lamp 11 of this embodiment satisfies the relationship $$0<(100BW/f)-P_0d<100 \quad \text{Equation 6}$$

Furthermore, when P(MPa) is the pressure of the enclosed rare gas at 20° C., then the lamp 11 satisfies the relationship $$0<(10BW/f)-Pd<10 \quad \text{Equation 7}$$

Because of the fact that the pressure P of the enclosed rare gas can be measured more easily than the operating pressure $P_0$ and because there is no particular problem in specifying the configuration, not with the operating pressure $P_0$, but with the pressure P of the enclosed rare gas, it is much more advantageous for the lamp design to specify the configuration according to Equation 7. But it is of course also no problem to specify the configuration according to Equation 6, which includes the operating pressure $P_0$.

With a configuration in which these relationships are satisfied, a mercury-free high-intensity discharge lamp operating apparatus 100 with suppressed arc vibrations was realized. The following are examples of those parameters for the lamp operating apparatus 100 that showed the best results in the various experiments performed by the inventors of the present invention. With regard to parameters that are not listed below, the parameters from the above-described configuration are used. For example, the internal volume of the arc tube 1 is about 0.025 cc.

| enclosed material | |
|---|---|
| trivalent indium iodide ($InI_3$): | 0.1 mg |
| thallium iodide (TlI): | 0.1 mg |
| scandium iodide ($ScI_3$): | 0.19 mg |
| sodium iodide (NaI): | 0.06 mg |
| rare gas | |
| xenon gas: | 1.4 MPa (pressure at 20° C.) |
| distance between the electrodes | |
| d: 4 mm | |
| operating conditions | |
| B: 5 mT, W: 35 W, f: 150 Hz | |

At these conditions, Equations 6 and 7 are $$0<(100BW/f)-P_0d<100, \quad \text{Equation 6}$$

and correspondingly $$0<(10BW/f)-Pd<10=5.3 \quad \text{Equation 7}$$

Based on these conditions, operation at which absolutely no flickering is perceived (optical output variations: <1%) and without devitrification throughout the lamp's lifetime was attained.

In this embodiment and in the example of the preferable conditions above, four types of metal halides were used, but the present invention is not limited to this. The reason for this is that, as shown in FIG. 6, in mercury-free high-intensity discharge lamps, the proportion taken up by the metal halide gas during the lamp's operation is small compared with that of the rare gas (xenon), and the upward force on the arc (buoyancy) F1 is almost completely caused by the rare gas, so that it does not depend on the types of metal halide used. The metal halides are not limited to iodides, and they can also be bromides, chlorides, or other metallic elements or their metallic compounds.

Among halides, indium halides, preferably $InI_3$ and/or InI (and most preferably $InI_3$) increase the lamp voltage, so that the lamp can be operated at a lower current, and the ballast can be made smaller, and furthermore, they increase the light emission efficiency, so that it is preferable to include them in the arc tube 1 in view of practical aspects. $InI_3$, InI and TlI are halides with a high vapor pressure, and metal halides (including for example $InI_3$) whose vapor pressure at for example 900° C. is at least 1 atm can be used preferably as the enclosed material 6 filled into the metal halide lamp.

Furthermore, in this embodiment, xenon gas was used as the rare gas, but there is no limitation to that, and other rare gases such as argon or krypton as well as their mixtures can be used, too. Furthermore, since the upward force F1 on the arc is based on the term Pd, it does not depend on the shape or the volume of the arc tube 1. It seems that this is so because factors such as the shape and the volume of the arc tube 1 are already reflected by the pressure P. Therefore, in this embodiment, the volume V of the arc tube was taken to be 0.025 (cc), but there is no limitation to this. In addition, in this embodiment, the material constituting the arc tube 1 was shown to be quartz glass, but the material of the arc tube is not limited to this, and can also be alumina, YAG or any other suitable ceramic material, for example. In the present embodiment, the arc tube 1 is enclosed by an outer tube 14, but there is no limitation to this configuration, and other configurations without an outer tube 14 are of course also possible.

Furthermore, there is no limitation to configurations in which the permanent magnet 10 is fixed to the outer lead wire 5, as long as it is fixed reliably, so that it can form a magnetic field as shown in the present embodiment inside the arc tube. Furthermore, the same effect can also be attained when an electromagnet is used instead of the permanent magnet 10 for the magnetic field application means. For the permanent magnet 10, a ferrite permanent magnet, an alnico magnet, or a rare-earth permanent magnet can be used for example. A ferrite permanent magnet is inexpensive and common, so that it is advantageous with regard to costs. Considering the effect that increasing temperature lower the magnetic force, it is preferable that the permanent magnet is arranged at a position where it is not easily susceptible to the heat of the lamp. If an alnico magnet is used, the magnetic force decreases only little when the temperature rises, so that the magnet can be arranged close to the lamp, Moreover, the alnico magnet can be smaller than when using a ferrite permanent magnet. In case of a rare-earth permanent magnet with very high magnetic force, an even smaller magnet can be used.

Also, there is no particular limitation with regard to the magnetic force lines (polarity of N- and S-pole). There is no limitation to only one permanent magnet or electromagnet, and it is also possible to provide magnets above and below the arc tube 1. Also, in this embodiment, the waveform of the current applied by the ballast 12 to the lamp 11 is a square wave, but there is no limitation to this, and it can also be a sine wave or a triangular wave.

Figure 9:
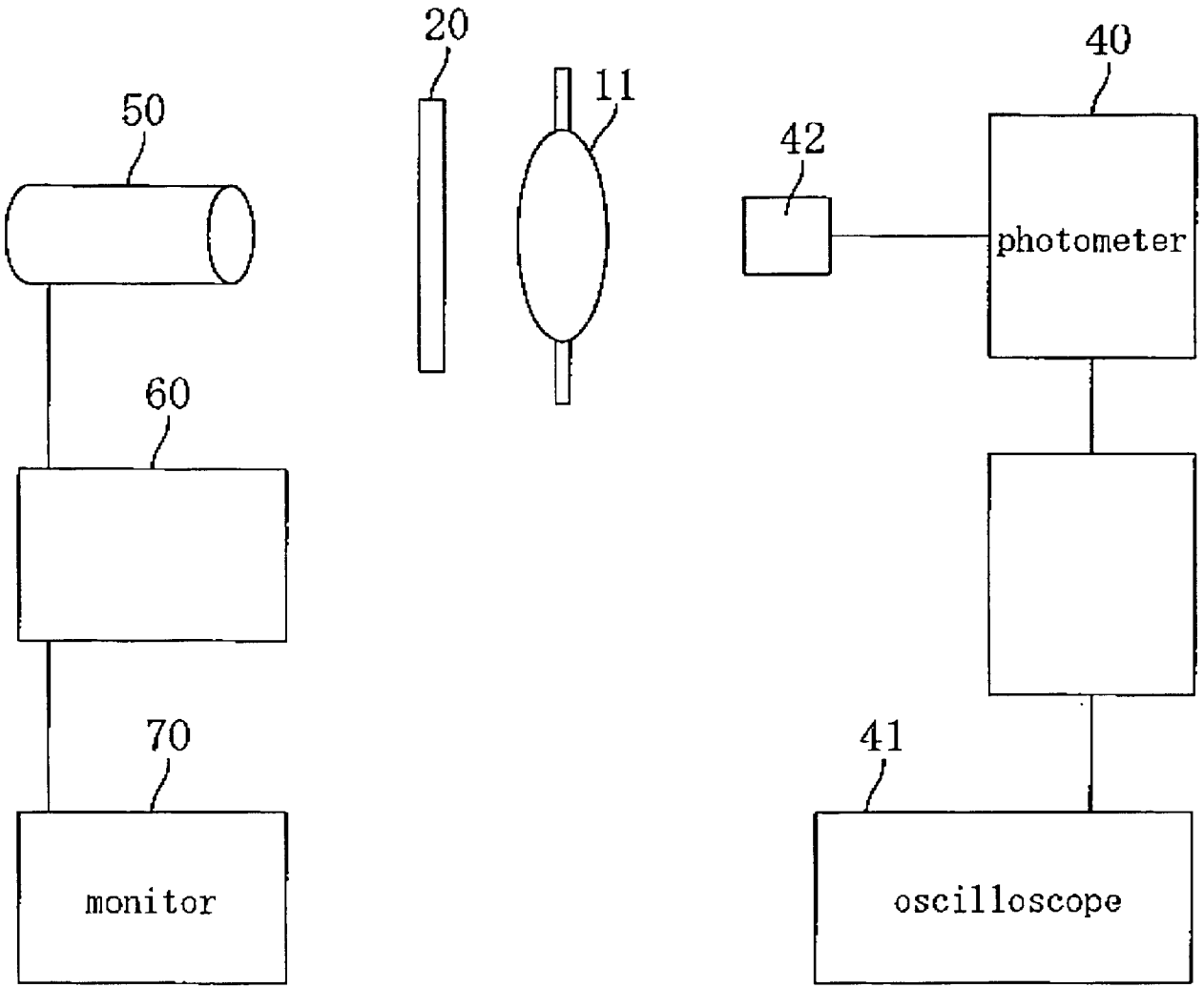
FIG. 9 is a diagram of the experimental apparatus used for measuring variations of the optical output.

The following illustrates the experiments that the inventors of the present invention performed in order to study the vibration (flickering) of the arc and the extent to which it was suppressed, as well as the results from these experiments. In order to study the vibration of the arc, it is suitable to study the variations in the optical output. FIG. 9 schematically shows the configuration of an experimental device used to measure variations in the optical output.

As shown in FIG. 9, to quantify the curving and the flickering of the arc, a measurement head 42 of a photometer 40 was placed near the lamp 11 and the change of the optical output from the photometer 40 was observed with an oscilloscope 41, after passing it through a lowpass filter (LPF) in order to cut noise. The appearance of the curving and the flickering of the arc of the lamp 11 was picked up with a CCD 50, and this image was recorded with a VTR 60 and displayed on a monitor 70, where the curving and the flickering of the arc was observed by a test person. A filter 20 was disposed between the lamp 11 and the CCD 50.

Furthermore, a lifetime test was performed. The lifetime test was carried out by turning the lamp on and off, taking the modes shown in Table 1 below as one cycle and repeating these modes. The operating time was taken to be the overall time that the lamp was on.

TABLE 1

| Sequence No. | ON time | OFF time |
|---|---|---|
| 1 | 20 min | 12 sec |
| 2 | 8 min | 5 min |
| 3 | 5 min | 3 min |
| 4 | 3 min | 3 min |
| 5 | 2 min | 3 min |
| 6 | 1 min | 3 min |
| 7 | 30 sec | 3 min |
| 8 | 18 sec | 18 sec |
| 9 | 20 min | 4 min 42 sec |

In this experiment, the curving and flickering of the arc as well as the lifetime characteristics were measured, taking the power W consumed by the lamp 11 during steady-state operation with the ballast 12 and the operating frequency f during steady-state operation as parameters. Regarding the power W, the parameters were set to the four levels 20, 35, 50 and 70 (W), whereas the operating frequency was measured between 30 and 20000 (Hz) where no acoustic resonance occurs. Also, the measurement was performed using a square wave as the waveform of the operating current. The results are shown in FIGS. 10 and 11.

Figure 10:
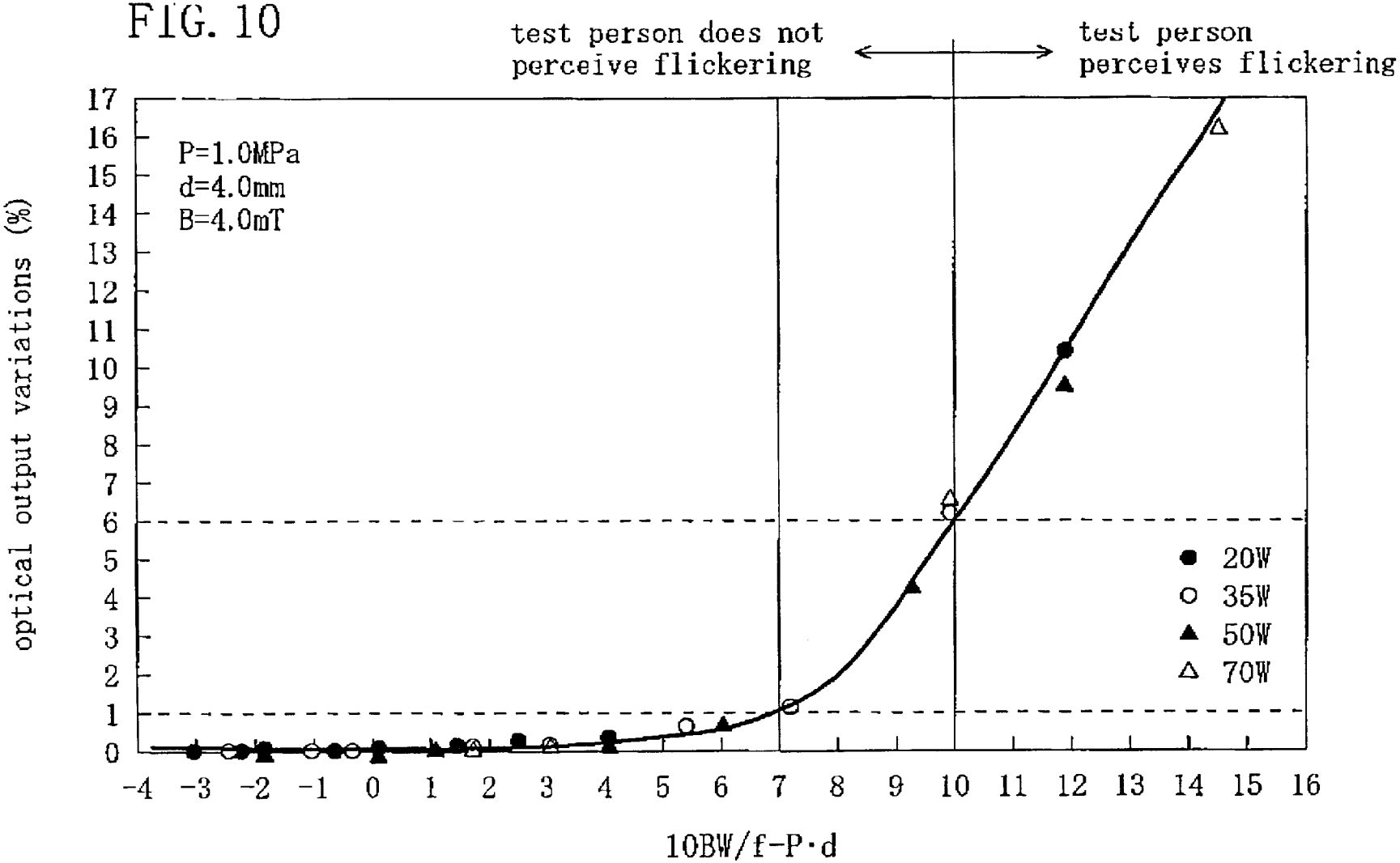
FIG. 10 is a graph illustrating the relationship between 10BW/f−P·d and the variations of the optical output when the magnetic field B is 4.0 (mT).
Figure 11:
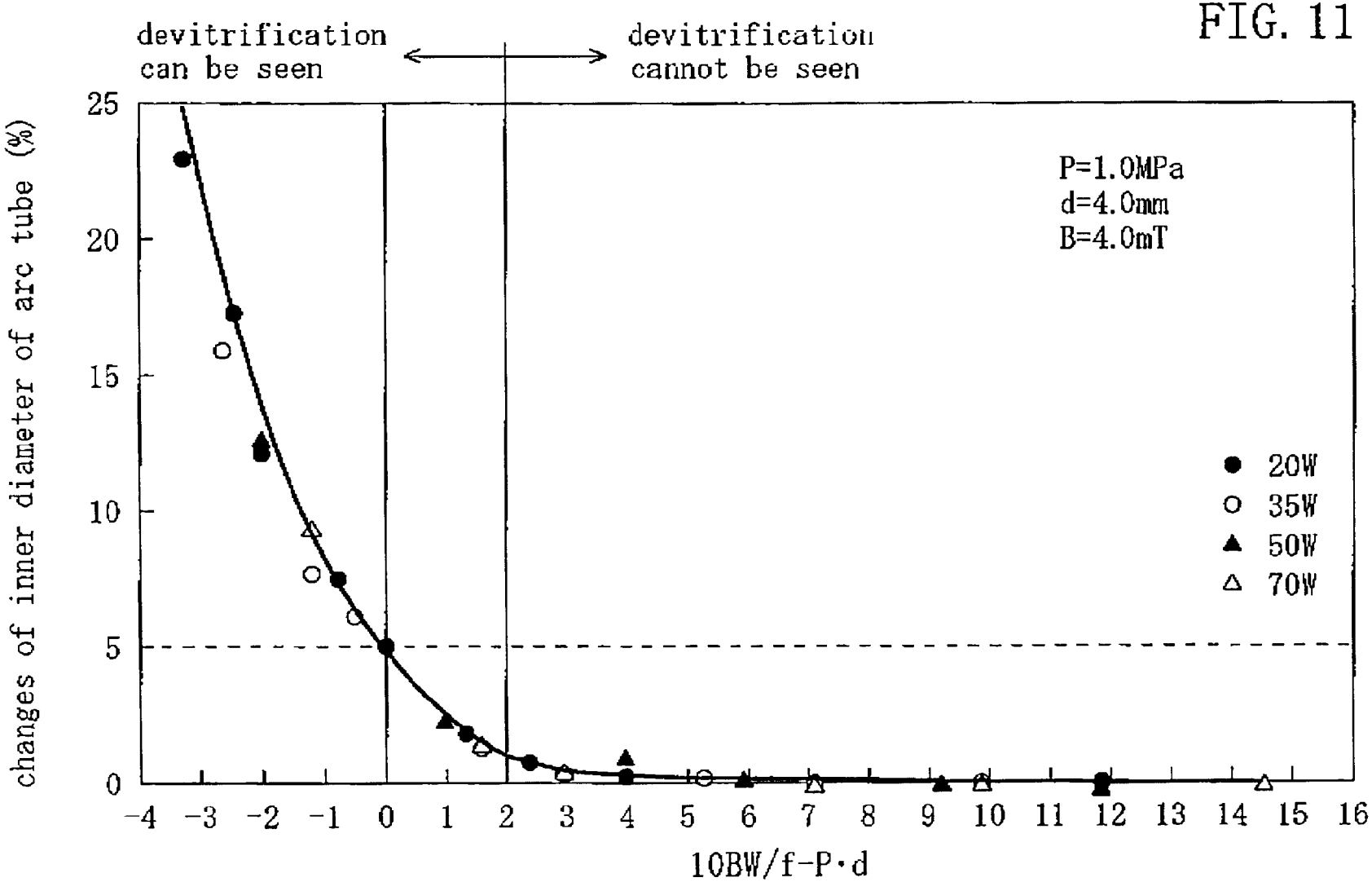
FIG. 11 is a graph illustrating the relationship between 10BW/f−P·d and the rate of change of the inner diameter of the arc tube when the magnetic field B is 4.0 (mT).

FIG. 10 is a graph showing the results of examining the flickering by measuring the variations in the optical output. The horizontal axis in FIG. 10 marks the value of 10BW/f−P·d, wherein P(MPa) is the pressure of the enclosed rare gas, whereas the vertical axis marks the variation (%) of the optical output. Here, the variation of the optical output is shown as the value (in %) of the difference between the maximum and the minimum of the optical output divided by the average of the optical output.

As can be seen in FIG. 10, the variation of the optical output of the lamp 11 depends on 10BW/f−P·d. When 10BW/f−P·d exceeds 7, the variation of the optical output exceeds 1(%), reaching a level for which it can be said that variation occurs. When 10BW/f−P·d exceeds 10, the variation Of the optical output exceeds 6%. When 6% were exceeded, the test person perceived this as flickering.

Therefore, by setting 10BW/f−P·d within a range that does not exceed 10, it is possible to realize a mercury-free high-intensity discharge lamp, with which a test person does not perceive flickering. Setting 10BW/f−P·d within a range that does not exceed 7, it is not only possible to realize a mercury-free high-intensity discharge lamp with which flickering is not perceived, but also one without optical output variations, which is more preferable.

FIG. 11 is a graph showing the results of examining the occurrence of deformations and devitrification in the arc tube by measuring the changes in the internal diameter of the arc tube. As in FIG. 10, the horizontal axis in FIG. 11 marks the value of 10BW/f−p·d. The vertical axis marks the value (in %) of the change of the internal diameter of the arc tube 1 after 1000 hours of intermittent operation, divided by the initial internal diameter of the arc tube 1.

As can be seen in FIG. 11, the change of the internal diameter of the arc tube 1 of the lamp depends on 10BW/f−P·d. If the value of 10BW/f−P·d is lower than zero, the change of the internal diameter of the arc tube exceeds 5(%). in this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was smally devitrification in the upper portion of the arc tube was observed when the value of 10BW/f−P·d was lower than 2.

Therefore, by setting 10BW/f−P·d within a range that exceeds zero, it is possible to realize a mercury-free high-intensity discharge lamp with little deformations of the arc tube and excellent lifetime characteristics. Setting 10BW/f−P·d within a range that exceeds 2, it is not only possible to realize a mercury-free high-intensity discharge lamp with little deformations of the arc tube, but also one in which devitrification is suppressed and which has even better lifetime characteristics, which is more preferable.

Even though devitrification in the arc tube 1 or inner diameter changes of the arc tube 1 could not be acknowledged for lamp operating apparatuses 100 with an f not greater than 40 (Hz) within the range of 0<10BW/f−P·d<10, blackening was observed at the inner wall of the arc tube. In these lamp operating apparatuses, the lifetime characteristics were degraded, even though the effect of suppressing devitrification and inner diameter changes of the arc tube was attained. Therefore, it is preferable that the operating frequency during steady-state operation exceeds 40 (Hz).

Figure 12:
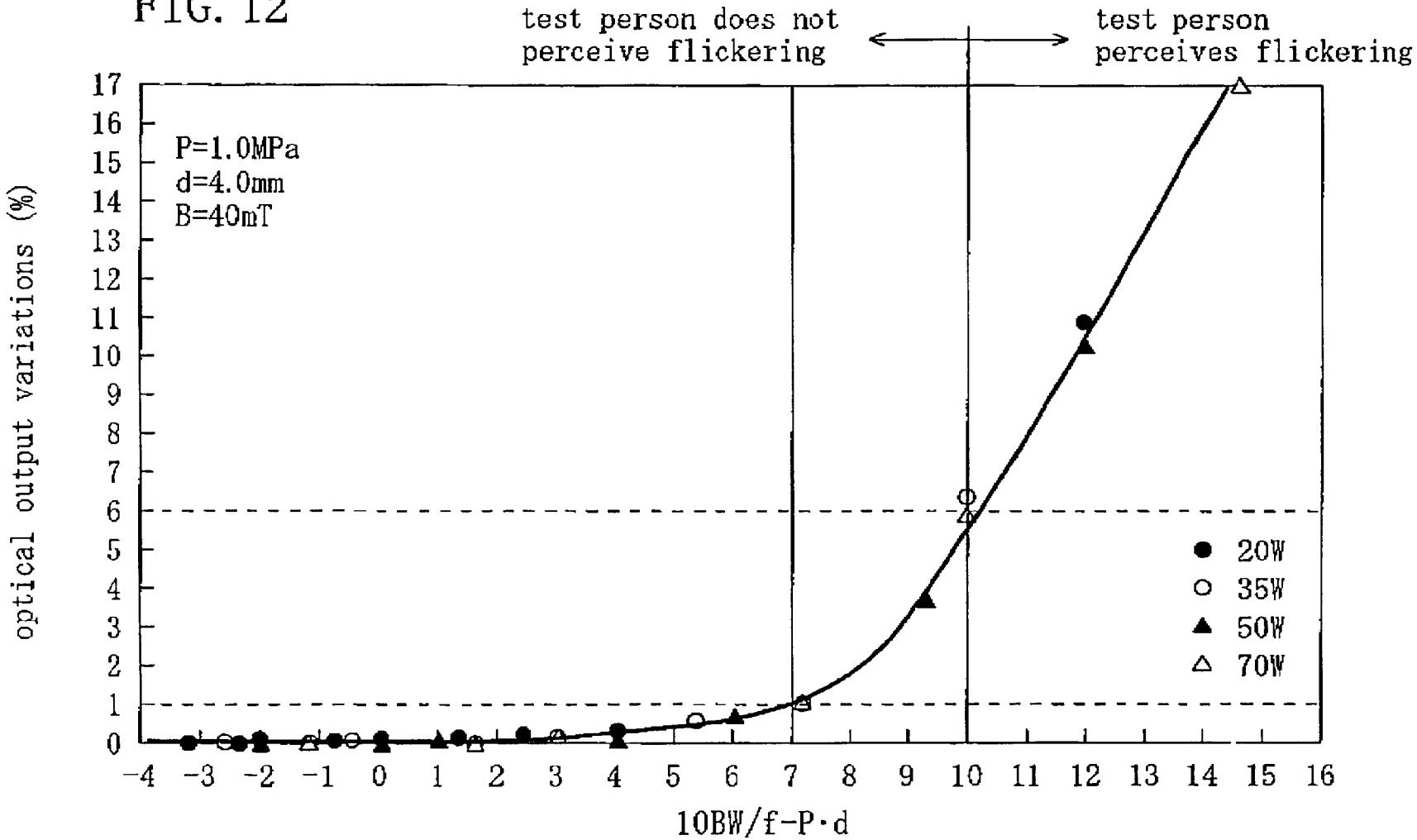
FIG. 12 is a graph illustrating the relationship between 10BW/f−P·d and the variations of the optical output when the magnetic field B is 40 (mT).
Figure 13:
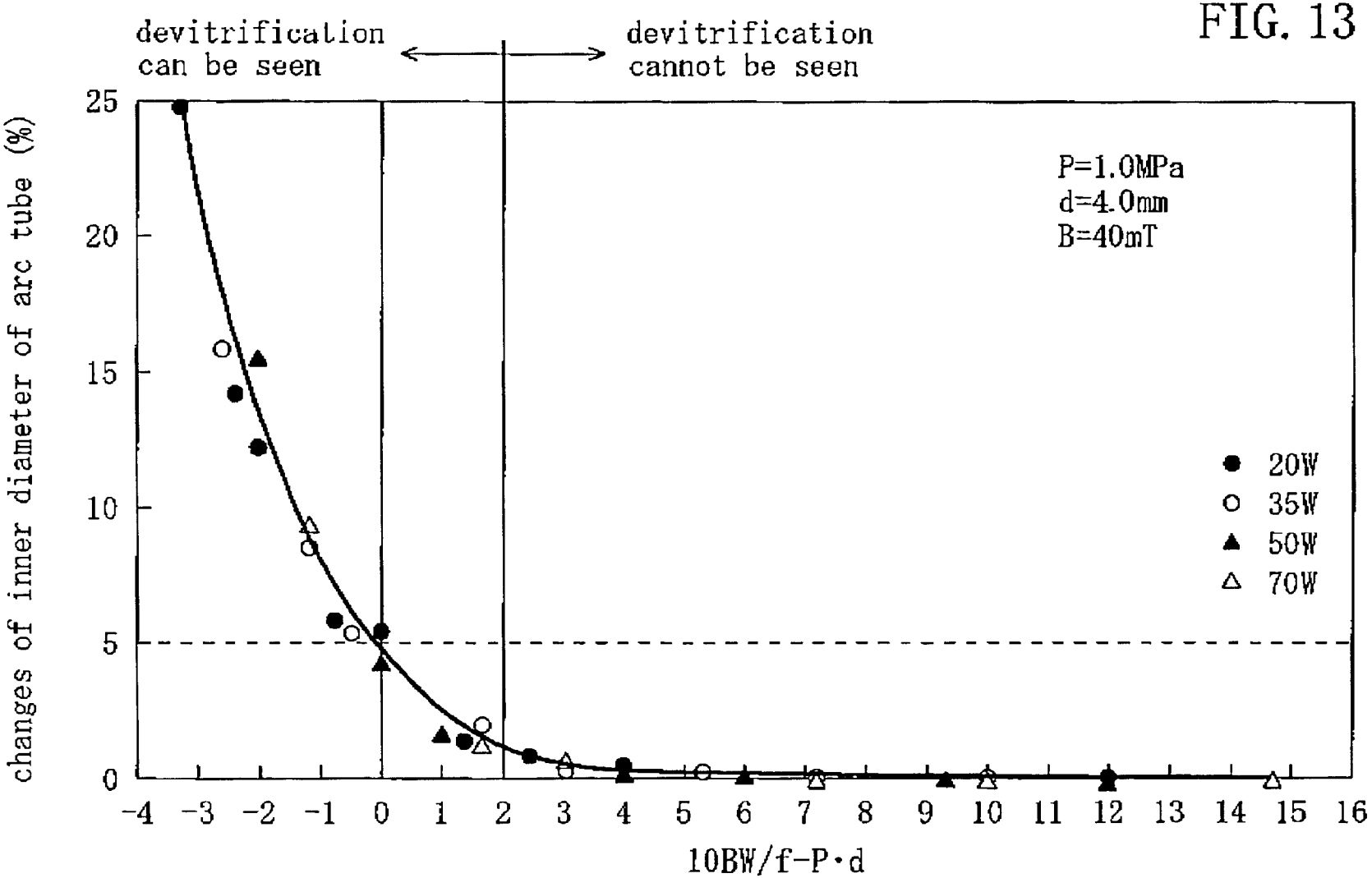
FIG. 13 is a graph illustrating the relationship between 10BW/f−P·d and the rate of change of the inner diameter of the arc tube when the magnetic field B is 40(mT).

Next, FIG. 12 and FIG. 13 show the results for the same configuration as for the lamp operating apparatus 100, but with the permanent magnet 10 adjusted such that a magnetic field B of 40 (mT) was applied in the arc. Also for the results shown in FIG. 12 and FIG. 13, the flickering and the lifetime characteristics were measured, taking the power W consumed by the lamp 11 during steady-state operation and the operating frequency f during steady-state operation as parameters, as in FIG. 10 and FIG. 11 The measurement was performed setting the power W to the four levels 20, 35, 50 and 70 (W), and varying the operating frequency between 30 and 20000 (Hz).

FIG. 12 is a graph showing the result of examining the flickering by measuring the variation in the optical output, as in FIG. 10. The horizontal axis and the vertical axis in FIG. 12 are the same as in FIG. 10.

As can be seen in FIG. 12, also when the magnetic field is set to 40 (mT), the variation of the optical output of the lamp 11 depends on 10BW/f−P·d, as when the magnetic field is 4 (mT). When 10BW/f−P·d exceeds 7, the variation of the optical output nearly exceeds 1(%), reaching a level for which it can be said that variation occurs when 10BW/f−P·d exceeds 10, the variation of the optical output nearly exceeds 6(%). In this situation, the test person perceived this as flickering.

Therefore, by setting 10BW/f−P·d within a range that does not exceed 10, it is possible to realize a mercury-free high-intensity discharge lamp, with which a test person does not perceive flickering. Setting 10BW/f−P·d within a range that does not exceed 7, it is not only possible to realize a mercury-free high-intensity discharge lamp with which flickering is not perceived, but also one without optical output variations, which is more preferable.

Even though devitrification in the arc tube 1 or inner diameter changes of the arc tube 1 could not be acknowledged for lamp operating apparatuses 100 with an f not greater than 40 (Hz) within the range of 0<10BW/f−P·d<10, blackening was observed at the inner wall of the arc tube. In these lamp operating apparatuses, the lifetime characteristics were degraded, even though the effect of suppressing devitrification and inner diameter changes of the arc tube was attained. Therefore, it is preferable that the operating frequency during steady-state operation exceeds 40 (Hz).

FIG. 13 is a graph showing the results of examining the occurrence of deformations and devitrification in the arc tube by measuring the changes in the internal diameter of the arc tube, as in FIG. 11. The horizontal axis and the vertical axis in FIG. 13 are as in FIG. 11.

As can be seen in FIG. 13, also when the magnetic field is set to 40 (mT), the change of the inner diameter of the arc tube 1 depends on 10BW/f−P·d, as when the magnetic field is 4 (mT) as shown in FIG. 11. If the value of 10BW/f−P·d is lower than zero, the change of the internal diameter of the arc tube exceeds 5(%). In this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was small, devitrification in the upper portion of the arc tube was observed when the value of 10BW/f−P·d was lower than 2.

Therefore, by setting 10BW/f−P·d within a range that exceeds zero, it is possible to realize a mercury-free high-intensity discharge lamp with little deformations of the arc tube and excellent lifetime characteristics. Setting 10BW/f−P·d within a range that exceeds 2, it is not only possible to realize a mercury-free high-intensity discharge lamp with little deformations of the arc tube, but also one in which devitrification is suppressed and which has even better lifetime characteristics, which is more preferable.

Figure 14:
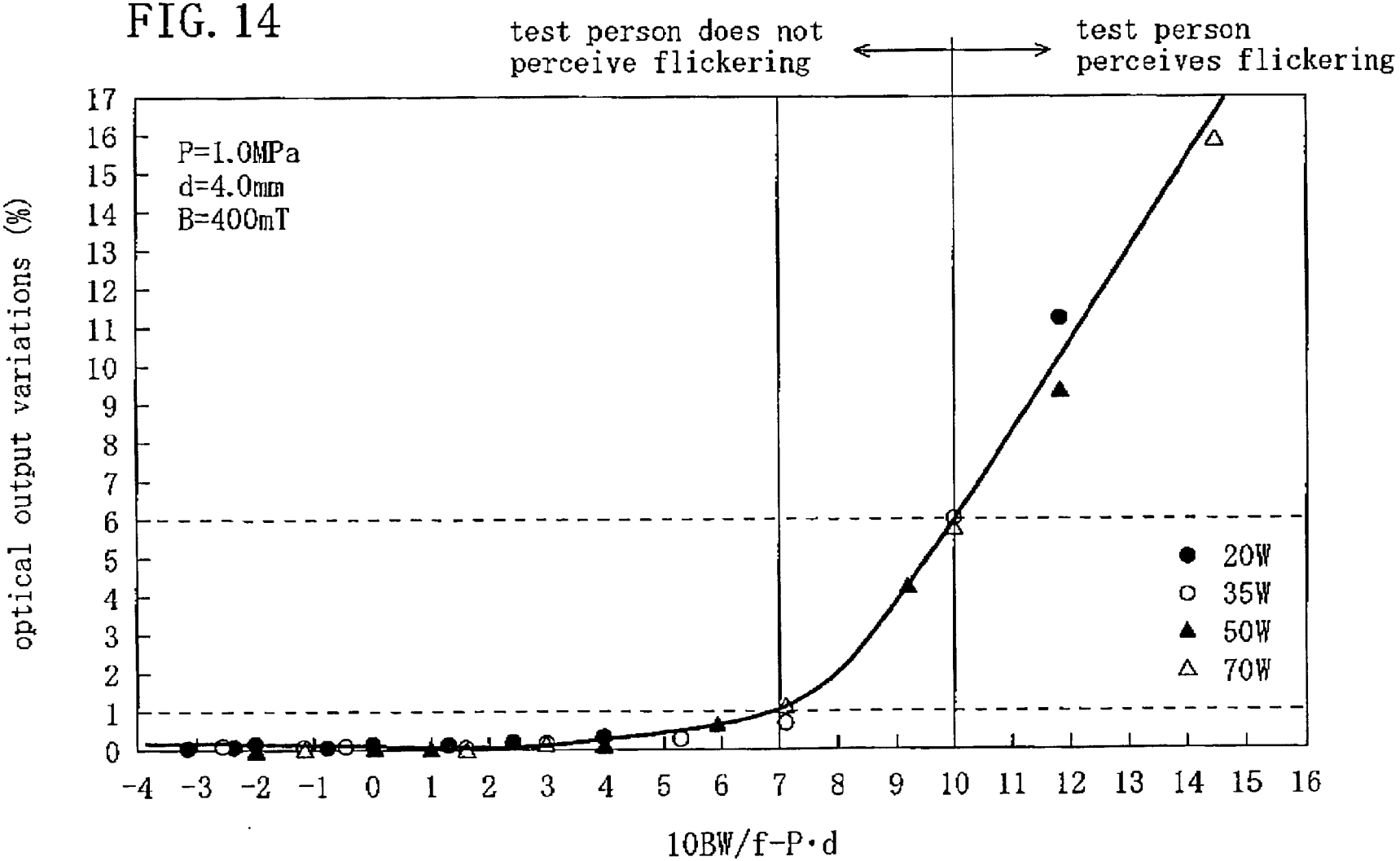
FIG. 14 is a graph illustrating the relationship between 10BW/f−P·d and the variations of the optical output when the magnetic field B is 400 (mT).
Figure 15:
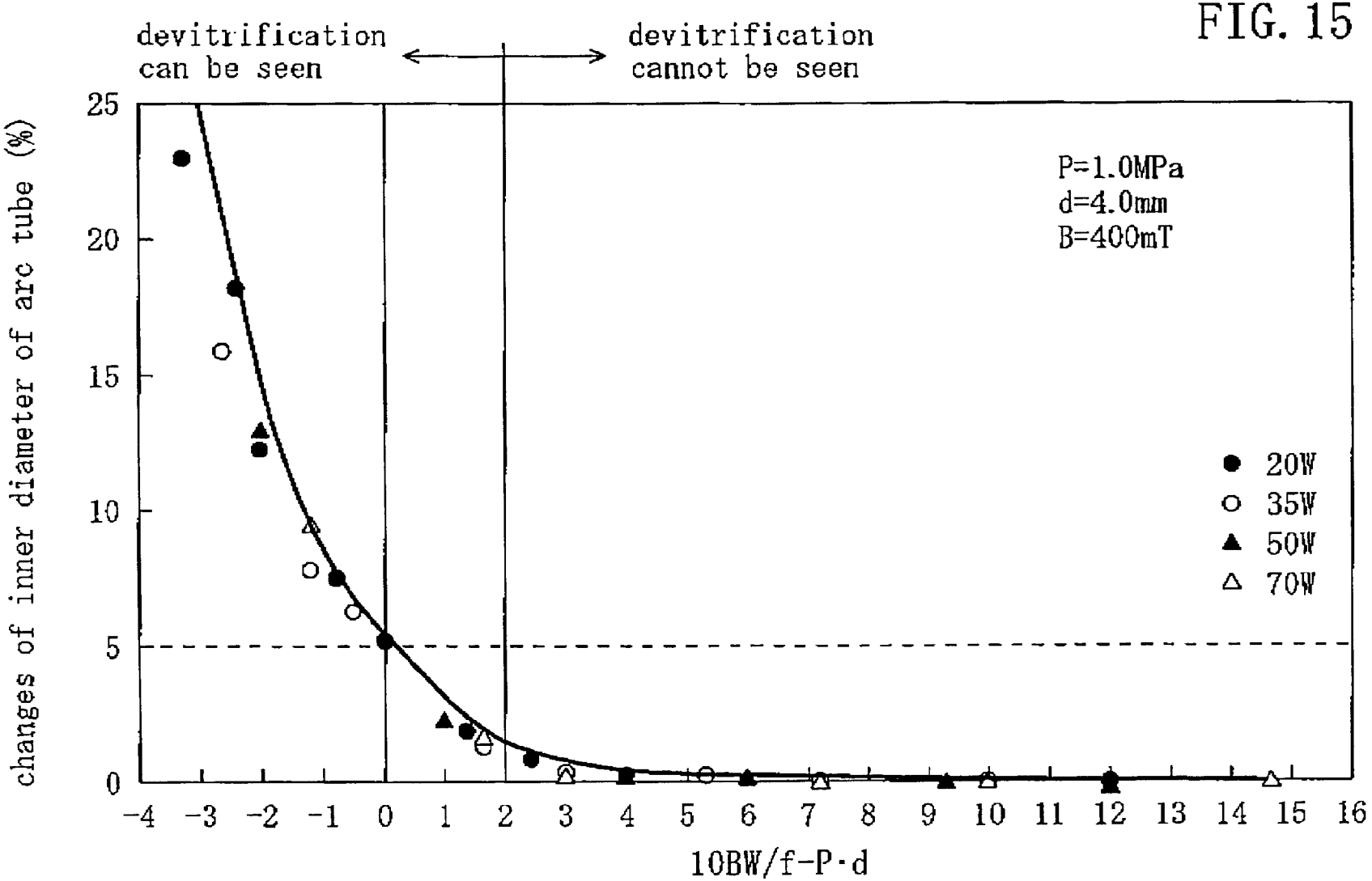
FIG. 15 is a graph illustrating the relationship between 10BW/f−P·d and the rate of change of the inner diameter of the arc tube when the magnetic field B is 400 (mT).

Next, FIG. 14 and FIG. 15 show the results for the same configuration as for the lamp operating apparatus 100, but with the permanent magnet 10 adjusted such that a magnetic field B of 400 (mT) was applied in the arc. Also for the results shown in FIG. 14 and FIG. 15, the flickering and the lifetime characteristics were measured, taking the power W consumed by the lamp 11 during steady-state operation and the operating frequency f during steady-state operation as parameters. The measurement was performed setting the power W to the four levels 20, 35, 50 and 70 (W), and varying the operating frequency between 30 and 20000 (Hz).

FIG. 14 is a graph showing the result of examining the flickering by measuring the variation in the optical output, as in FIG. 10. The horizontal axis and the vertical axis in FIG. 12 are the same as in FIG. 10.

As can be seen in FIG. 14, also when the magnetic field is set to 400(mT), the variation of the optical output of the lamp 11 depends on 10BW/f−P·d, as when the magnetic field is 4(mT) as shown in FIG. 10. When 10BW/f−P·d exceeds 7, the variation of the optical output nearly exceeds 1(%), reaching a level for which it can be said that variation occurs. When 10BW/f−P·d exceeds 10, the variation of the optical output nearly exceeds 6(%). In this situation, the test person perceived this as flickering.

Therefore, by setting 10BW/f−P·d within a range that does not exceed 10, it is possible to realize a mercury-free high-intensity discharge lamp, with which a test person does not perceive flickering. Setting 10BW/f−P·d within a range that does not exceed 7, it is not only possible to realize a mercury-free high-intensity discharge lamp with which flickering is not perceived, but also one without optical output variations, which is more preferable.

Even though devitrification in the arc tube 1 or inner diameter changes of the arc tube 1 could not be acknowledged for lamp operating apparatuses 100 with an f not greater than 40 (Hz) within the range of 0<10BW/f−P·d<10, blackening was observed at the inner wall of the arc tube. In these lamp operating apparatuses, the lifetime characteristics were degraded, even though the effect of suppressing devitrification and inner diameter changes of the arc tube was attained. Therefore, it is preferable that the operating frequency during steady-state operation exceeds 40(Hz).

FIG. 15 is a graph showing the results of examining the occurrence of deformations and devitrification in the arc tube by measuring the changes in the internal diameter of the arc tube, as in FIG. 11. The horizontal axis and the vertical axis in FIG. 15 are as in FIG. 11.

As can be seen in FIG. 15, also when the magnetic field is set to 400 (mT), the change of the inner diameter of the arc tube 1 depends on 10BW/f−P·d, as when the magnetic field is 4 (mT) as shown in FIG. 11. If the value of 10BW/f−P·d is lower than zero, the change of the internal diameter of the arc tube exceeds 5(%). In this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was small, devitrification in the upper portion of the arc tube was observed when the value of 10BW/f−P·d was lower than 2.

Therefore, by setting 10BW/f−P·d within a range that exceeds zero, it is possible to realize a mercury-free high-intensity discharge lamp with little deformations of the arc tube and excellent lifetime characteristics. Setting 10BW/f−P·d within a range that exceeds 2, it is not only possible to realize a mercury-free high-intensity discharge lamp with little deformations of the arc tube, but also one in which devitrification is suppressed and which has even better lifetime characteristics, which is more preferable.

Furthermore, when the same experiment was carried out with a high-intensity discharge lamp apparatus 100 in which the magnetic field applied in the arc was 500(mT), it was found that a mercury-free high-intensity discharge lamp operating apparatus without flickering and with excellent lifetime characteristics was attained in a range within 0<10BW/f−P·d<10, just as when applying a magnetic field of 4 (mT). However, when a magnetic field of 500 (mT) was applied in the arc, an occasional malfunctioning of the circuit was observed. The reason for this is that the electric field is not only applied to the arc, but also to the circuit and the current supplying lines, so that it is preferable that the magnetic field applied in the arc is in a range that does not exceed 500 (mT).

Embodiment 2

Embodiment 1 has described the characteristics when changing mainly the strength of the magnetic field, whereas this embodiment will describe the characteristics when changing the pressure of the rare gas enclosed in the arc tube 1. Other aspects are as in Embodiment 1, so that their description has been omitted or simplified.

Figure 2:
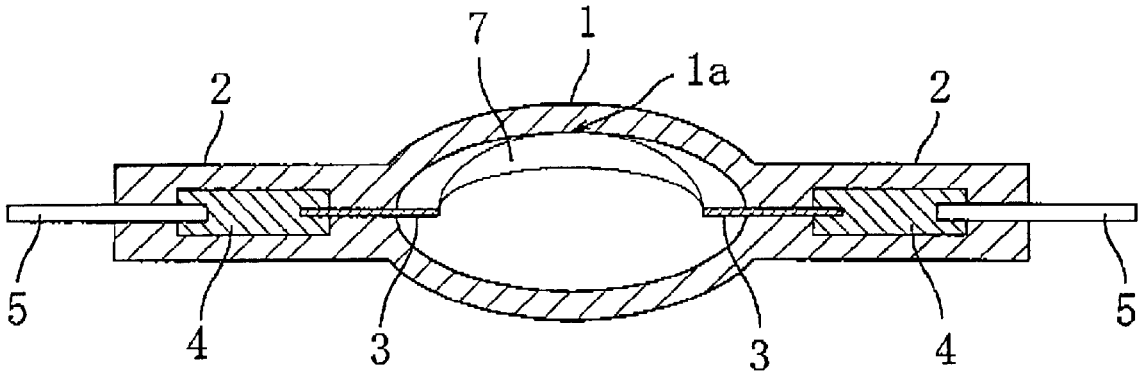
FIG. 2 is a cross-sectional drawing illustrating how the arc curves upward.

The mercury-free high-intensity discharge lamp operating apparatus and the high-intensity discharge lamp of the present embodiment have the same configuration as that of the mercury-free high-intensity discharge lamp operating apparatuses 100 in FIG. 1 and FIG. 2. In this embodiment, the magnetic field B applied to the arc was fixed at 4.0 (mT), and the pressure P of the xenon gas enclosed in the arc tube 21 was set to 0.1 (MPa), and the flickering and the lifetime characteristics were measured, taking the power W consumed during steady-state operation and the operating frequency f during steady-state operation as parameters. As in Embodiment 1, the measurement was performed setting the power W to the four levels 20, 35, 50 and 70 (W), and varying f between 30 and 20000 (Hz).

Figure 16:
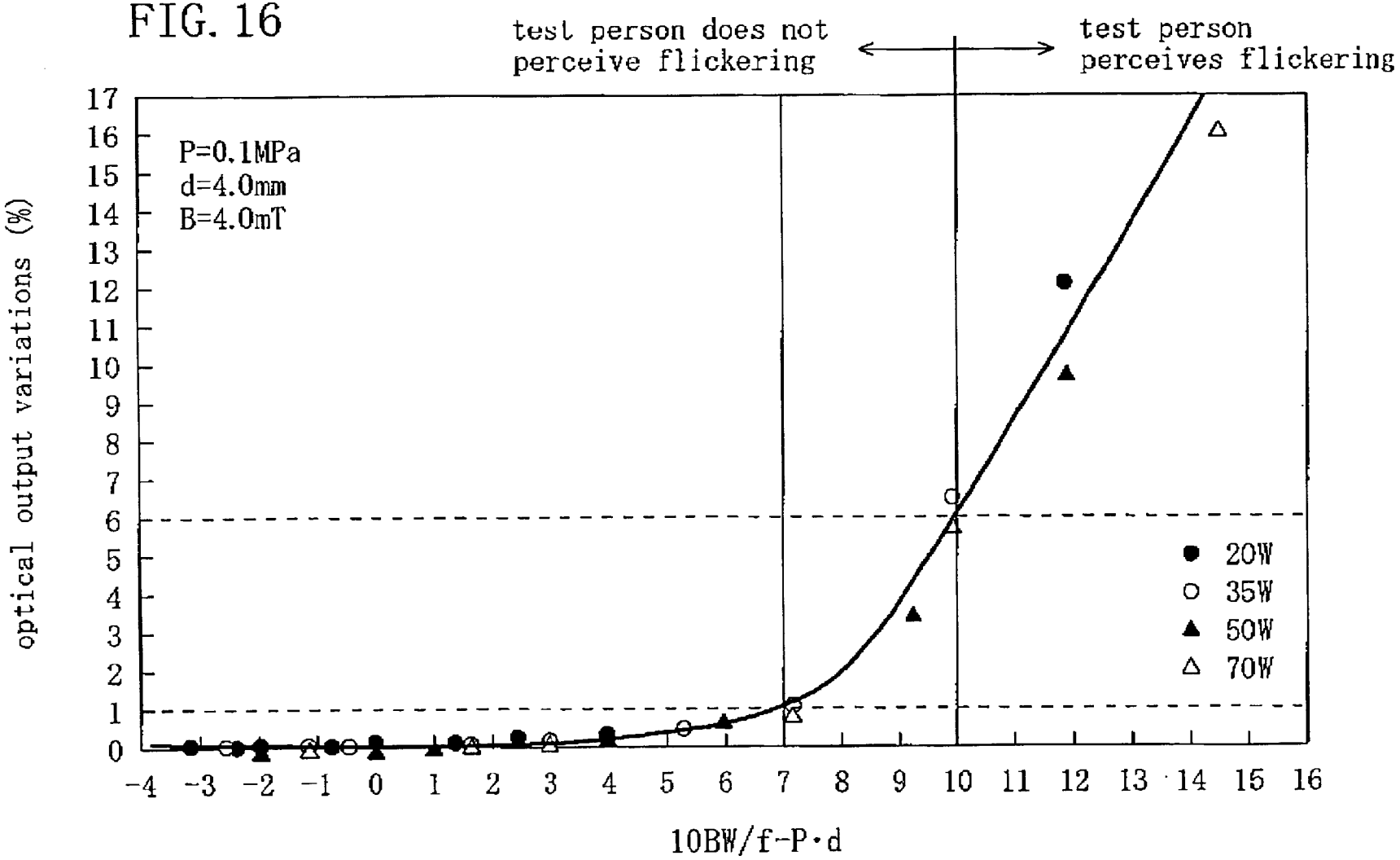
FIG. 16 is a graph illustrating the relationship between 10BW/f−P·d and the variations of the optical output when the pressure of the enclosed rare gas at 20(°C.) is 0.1 (MPa).

FIG. 16 is a graph showing the results of examining the flickering by measuring the variations in the optical output. The horizontal axis and the vertical axis in FIG. 16 are the same as in FIG. 10.

As can be seen in FIG. 16, also when the magnetic field was held constant and the pressure of the xenon gas was set to 0.1 MPa, the variation of the optical output of the lamp 11 depends on 10BW/f–P·d, as in Embodiment 1. When 10BW/f–P·d exceeds 7, the variation of the optical output nearly exceeds 1(%), reaching a level for which it can be said that variation occurs. When 10BW/f–P·d exceeds 10 the variation of the optical output nearly exceeds 6(%). In this situation, the test person perceived flickering.

Therefore, by setting 10BW/f–P·d within a range that does not exceed 10, it is possible to realize a mercury-free high-intensity discharge lamp, with which a test person does not perceive flickering. Setting 10BW/f–P·d within a range that does not exceed 7, it is not only possible to realize a mercury-free high-intensity discharge lamp with which flickering is not perceived, but also one without optical output variations, which is more preferable.

Figure 17:
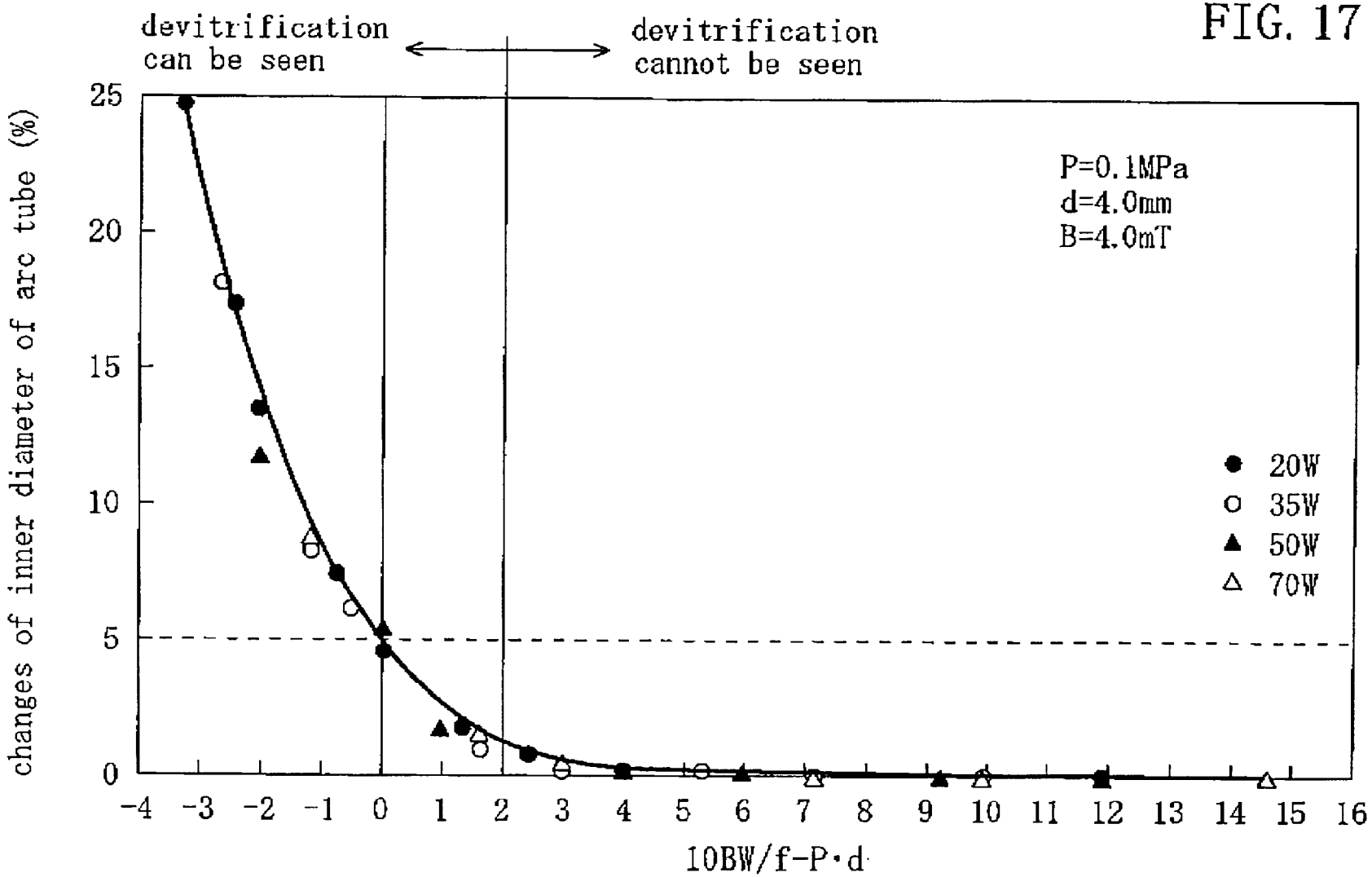
FIG. 17 is a graph illustrating the relationship between 10BW/f−P·d and the rate of change of the inner diameter of the arc tube when the pressure of the enclosed rare gas at 20(°C.) is 0.1 (MPa).

FIG. 17 is a graph showing the results of examining the occurrence of deformations and devitrification in the arc tube by measuring the changes in the internal diameter of the arc tube, as in FIG. 11. The horizontal axis and the vertical axis in FIG. 17 are the same as in FIG. 11.

As can be seen in FIG. 17, also when the magnetic field is held constant and the pressure of the xenon gas is set to 0.1 (MPa), the change of the internal diameter of the arc tube 1 depends on 10BW/f–P·d, as in Embodiment 1. If the value of 10BW/f–P·d is lower than zero, the change of the internal diameter of the arc tube nearly exceeds 5(%). In this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was small, devitrification in the upper portion of the arc tube was observed when the value of 10BW/f–P·d was lower than 2.

Therefore, by setting 10BW/f–P·d within a range that exceeds zero, it is possible to realize a mercury-free high-intensity discharge lamp with little deformations of the arc tube and excellent lifetime characteristics. Setting 10BW/f–P·d within a range that exceeds 2, it is not only possible to realize a mercury-free high-intensity discharge lamp with little deformations of the arc tube, but also one in which devitrification is suppressed and which has even better lifetime characteristics, which is more preferable.

Even though, as in Embodiment 1, devitrification in the arc tube 1 or inner diameter changes of the arc tube 1 could not be acknowledged for mercury-free high-intensity discharge lamp operating apparatuses with an f not greater than 40 (Hz) within the range of 0<10BW/f–P·d<10, blackening was observed at the inner wall of the arc tube. In these lamp operating apparatuses the lifetime characteristics were degraded, even though the effect of suppressing devitrification and inner diameter changes of the arc tube was attained. Therefore, it is preferable that the operating frequency during steady-state operation exceeds 40 (Hz).

Furthermore, in a lamp operating apparatus with a pressure value P of 0.1 (MPa), the effects of preventing flickering and preventing the degrading of the lifetime characteristics were attained, but the following phenomenon was observed. Even though there were no optical output variations, in combination with a reflecting mirror, the phenomenon of momentary arc vibrations sometimes was noticed. In this case, although the variations of the optical output were 5(%) or less, a flickering of the emitted light was observed. Closely observing the lamp 11 in this situation revealed that the luminescent spot at the electrode heads shifted. In order to suppress such flickering of the emitted light, it is preferable that the value of the pressure P of the enclosed rare gas is set within a range that exceeds 0.1 (MPa).

Figure 18:
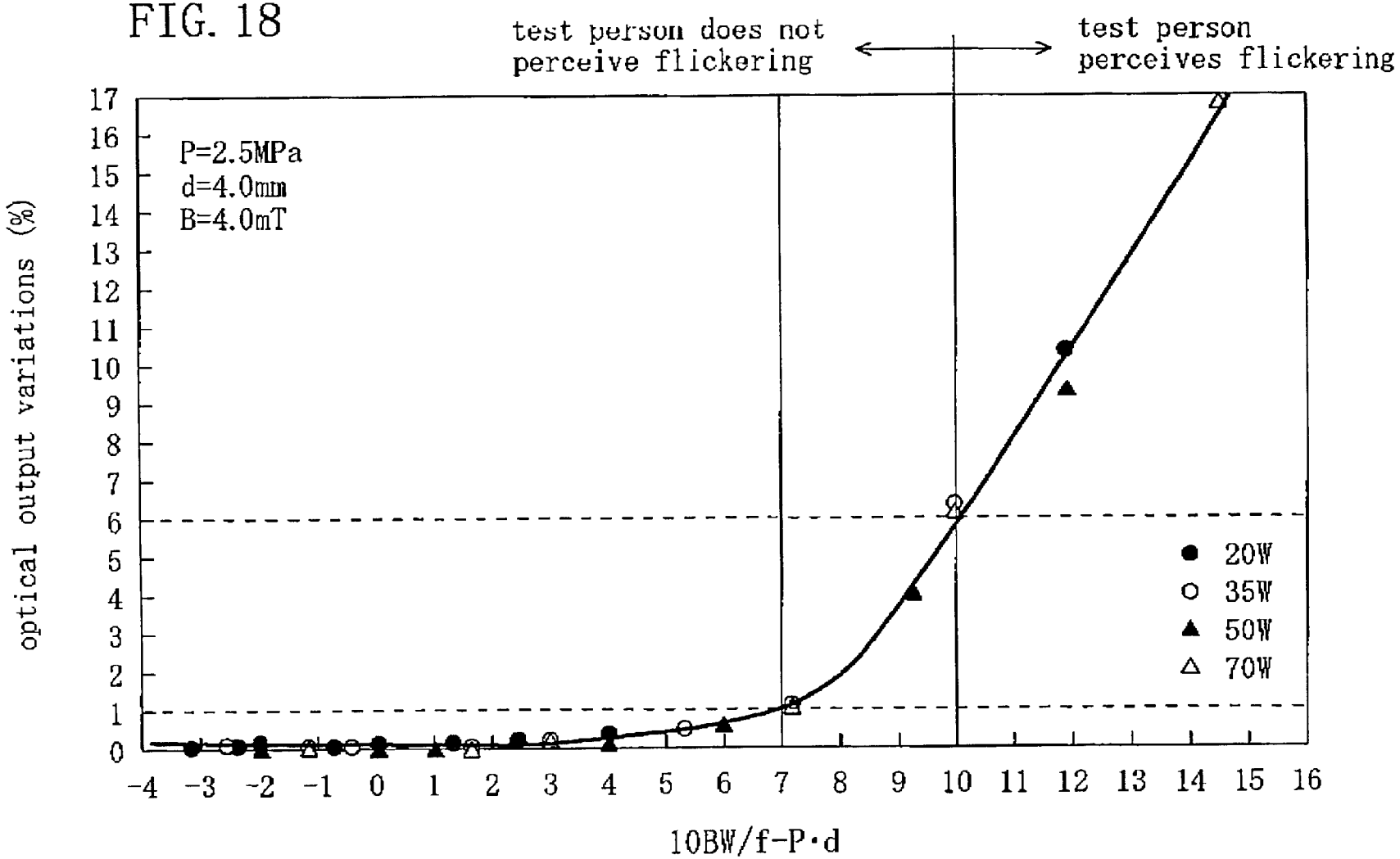
FIG. 18 is a graph illustrating the relationship between 10BW/f–P·d and the variations of the optical output when the pressure of the enclosed rare gas at 20 (°C.) is 2.5 (MPa).
Figure 19:
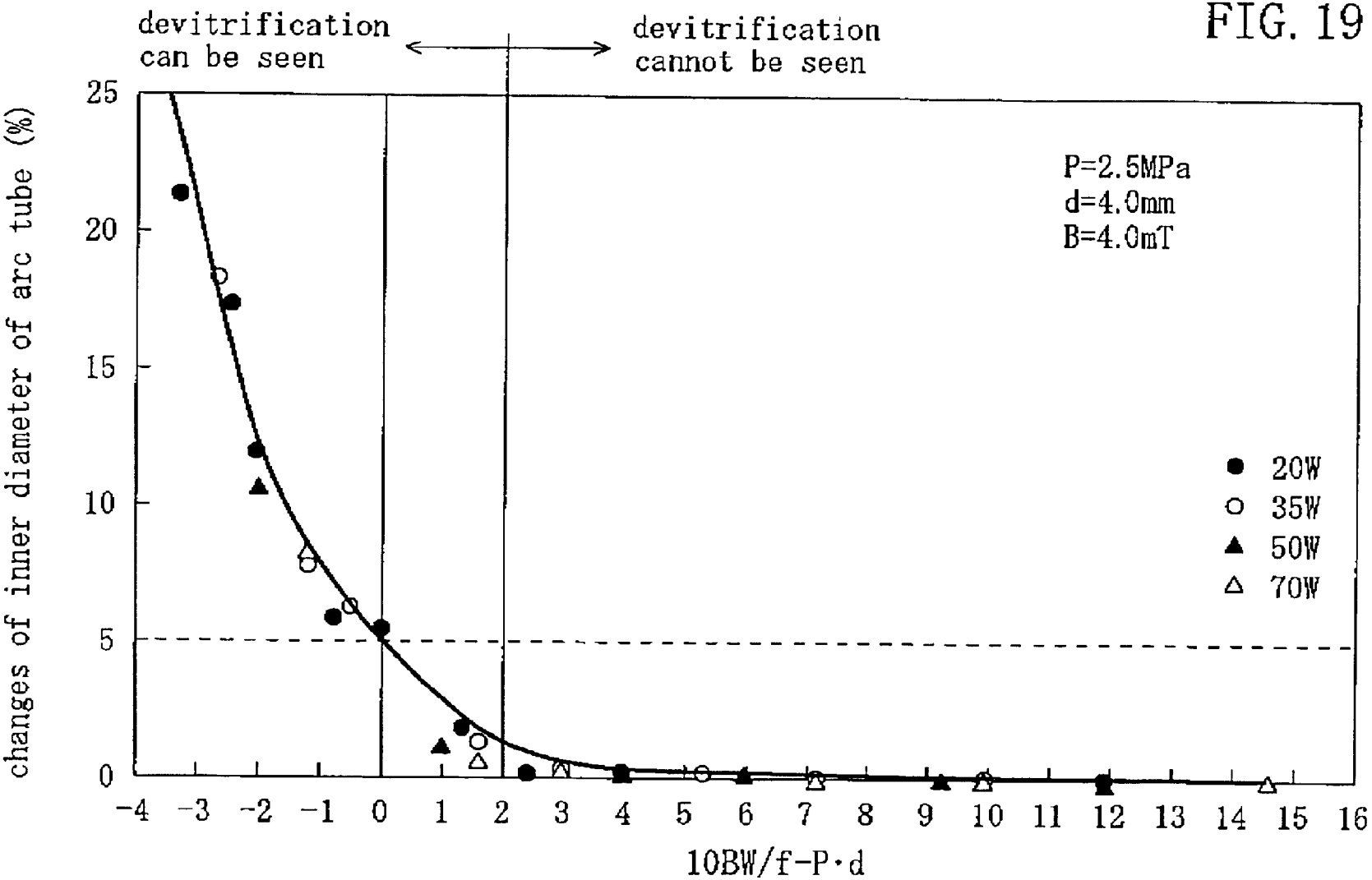
FIG. 19 is a graph illustrating the relationship between 10BW/f–P·d and the rate of change of the inner diameter of the arc tube when the pressure of the enclosed rare gas at 20(°C.) is 2.5 (MPa).

Next, FIG. 18 and FIG. 19 show the results for a configuration, in which the pressure P of the xenon gas was set to 2.5 (MPa). Also for the results shown in FIG. 18 and FIG. 19, the flickering and the lifetime characteristics were measured, taking the power W consumed by the lamp 11 during steady-state operation and the operating frequency f during steady-state operation as parameters. The measurement was performed setting the power w to the four levels 20, 35, 50 and 70 (W), and varying f between 30 and 20000 (Hz).

FIG. 18 is a graph showing the result of examining the flickering by measuring the variation in the optical output, as in FIG. 10. The horizontal axis and the vertical axis in FIG. 18 are the same as in FIG. 10.

As can be seen in FIG. 18, also when the magnetic field is held constant and the pressure of the xenon gas is set to 2.5 MPa, the variation of the optical output of the lamp 11 depends on 10BW/f–P·d, as in Embodiment 1. When 10BW/f–P·d exceeds 7, the variation of the optical output nearly exceeds 1(%), reaching a level for which it can be said that variation occurs. When 10BW/f–P·d exceeds 10, the variation of the optical output nearly exceeds 6(%). In this situation, the test person perceived flickering.

Therefore, by setting 10BW/f–P·d within a range that does not exceed 10, it is possible to realize a mercury-free high-intensity discharge lamp, with which a test person does not perceive flickering. Setting 10BW/f–P·d within a range that does not exceed 7, it is not only possible to realize a mercury-free high-intensity discharge lamp with which flickering is not perceived, but also one without optical output variations, which is more preferable.

FIG. 19 is a graph showing the results of examining the occurrence of deformations and devitrification in the arc tube by measuring the changes in the internal diameter of the arc tube, as in FIG. 11. The horizontal axis and the vertical axis in FIG. 19 are the same as in FIG. 11.

As can be seen in FIG. 19, also when the magnetic field is held constant and the pressure of the xenon gas is set to 2.5 (MPa), the change of the internal diameter of the arc tube 1 depends on 10BW/f–P·d, as in Embodiment 1. If the value of 10BW/f–P·d is lower than zero, the change of the internal diameter of the arc tube nearly exceeds 5(%). In this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was small, devitrification in the upper portion of the arc tube was observed when the value of 10BW/f–P·d was lower than 2.

Therefore, by setting 10BW/f–P·d within a range that exceeds zero, it is possible to realize a mercury-free high-intensity discharge lamp with little deformations of the arc tube and excellent lifetime characteristics. Setting 10BW/f–P·d within a range that exceeds 2, it is not only possible to realize a mercury-free high-intensity discharge lamp with little deformations of the arc tube, but also one in which devitrification is suppressed and which has even better lifetime characteristics, which is more preferable.

Here, mercury-free high-intensity discharge lamp operating apparatuses 100 with a value for P of 2.5 (MPa) is excellent in terms of the prevention of flickering and the degradation of the lifetime characteristics was attained, but two out of fifteen samples broke within 1000 hours and became inoperable. Thus, considering the usage time of high-intensity discharge lamps, it is preferable that the value of P is set within a range lower than 2.5 (MPa).

Furthermore, when making a mercury-free high-intensity discharge lamp operating apparatus 100 with a pressure value P of 0.3 (MPa) and evaluating the flickering and the lifetime characteristics, it was found that a mercury-free high-intensity discharge lamp operating apparatus without flickering and with excellent lifetime characteristics can be realized within a range of 0<10BW/f–P·d<10, as in Embodiment 1. However, immediately after turning on the lamp, a flickering caused by the low pressure was seen. The same phenomenon was observed with lamps enclosed at 0.1 (MPa). This seems to be caused by the fact that the heat distribution within the arc becomes nonuniform due to the low pressure immediately after turning on the lamp. Therefore, in order to avoid flickering immediately after turning on the lamp, it is preferable that the pressure P of the enclosed rare gas is set within a range exceeding 0.3(Mpa).

Next, when making a mercury-free high-intensity discharge lamp operating apparatus 100 with a pressure value P of 0.5 (MPa) and evaluating the flickering and the lifetime characteristics, it was found that a mercury-free high-intensity discharge lamp operating apparatus without flickering and with excellent lifetime characteristics can be realized within a range of 0<10BW/f–P·d<10, as in Embodiment 1. However, the phenomenon was seen that after turning on the lamp it takes more than 10 sec until the optical output of the lamp reaches 80% of the optical output during steady-state operation. This phenomenon could also be observed with lamps enclosed at 0.1 (MPa) and 0.3 (MPa). This seems to be caused by the fact that if the pressure of the enclosed rare gas is 0.5 (MPa) or less, the thermal conduction within the arc tube 21 is low so that the enclosed material 6 vaporizes less easily. Therefore, it is preferable that the pressure P of the enclosed rare gas is set within a range exceeding 0.5 (MPa).

Furthermore, when making a mercury-free high-intensity discharge lamp operating apparatus 100 with a pressure value P of 2.0 (MPa) and evaluating the flickering and the lifetime characteristics, it was found that a mercury-tree high-intensity discharge lamp operating apparatus without flickering and with excellent lifetime characteristics can be realized within a range of 0<10BW/f–P·d<10, as in Embodiment 1. However, this results in a start-up voltage exceeding 30 (kV). A driving circuit generating a start-up voltage in excess of 30 (kV) becomes larger, so that it is preferable that the value for P is lower than 2.0 (MPa), that is, it is preferable that the value for P·d is lower than 8.

Next, when making a mercury-free high-intensity discharge lamp operating apparatus 100 with a pressure value P of 1.5 (MPa) and evaluating the flickering and the lifetime characteristics it was found that a mercury-free high-intensity discharge lamp operating apparatus without flickering and with excellent lifetime characteristics can be realized within a range of 0<10BW/f–P·d<10, as in Embodiment 1. This results in a start-up voltage exceeding 25 (kV). At 25 (kV) or lower, the driving circuit can be made smaller due to the limited start-up voltage, so that it is preferable that the value for P is lower than 1.5 (MPa), that is, it is preferable that the value for P ·d is lower than 6.

Embodiment 3

In this embodiment, the characteristics when changing the distance between the heads of the electrodes of the lamp will be mainly described. Other aspects are as in Embodiments 1 and 2, so that their description has been omitted or simplified.

The mercury-free high-intensity discharge lamp operating apparatus and the high-intensity discharge lamp of the present embodiment have the same configuration as that of the mercury-free high-intensity discharge lamp operating apparatuses 100 in FIG. 1 and FIG. 2. In this embodiment, the magnetic field B applied to the arc was fixed at 4.0 (mT), the pressure P of the xenon gas was set to 1.0 (MPa), and the distance d between the heads of the pair of electrodes 3 was set to 2 mm. Then, the flickering and the lifetime characteristics were measured, taking the power W consumed during steady-state operation and the operating frequency f during steady-state operation as parameters. As in Embodiment 1, the measurement was performed setting the power W to the four levels 20, 35, 50 and 70 (W), and varying f between 30 and 20000 (Hz).

Figure 20:
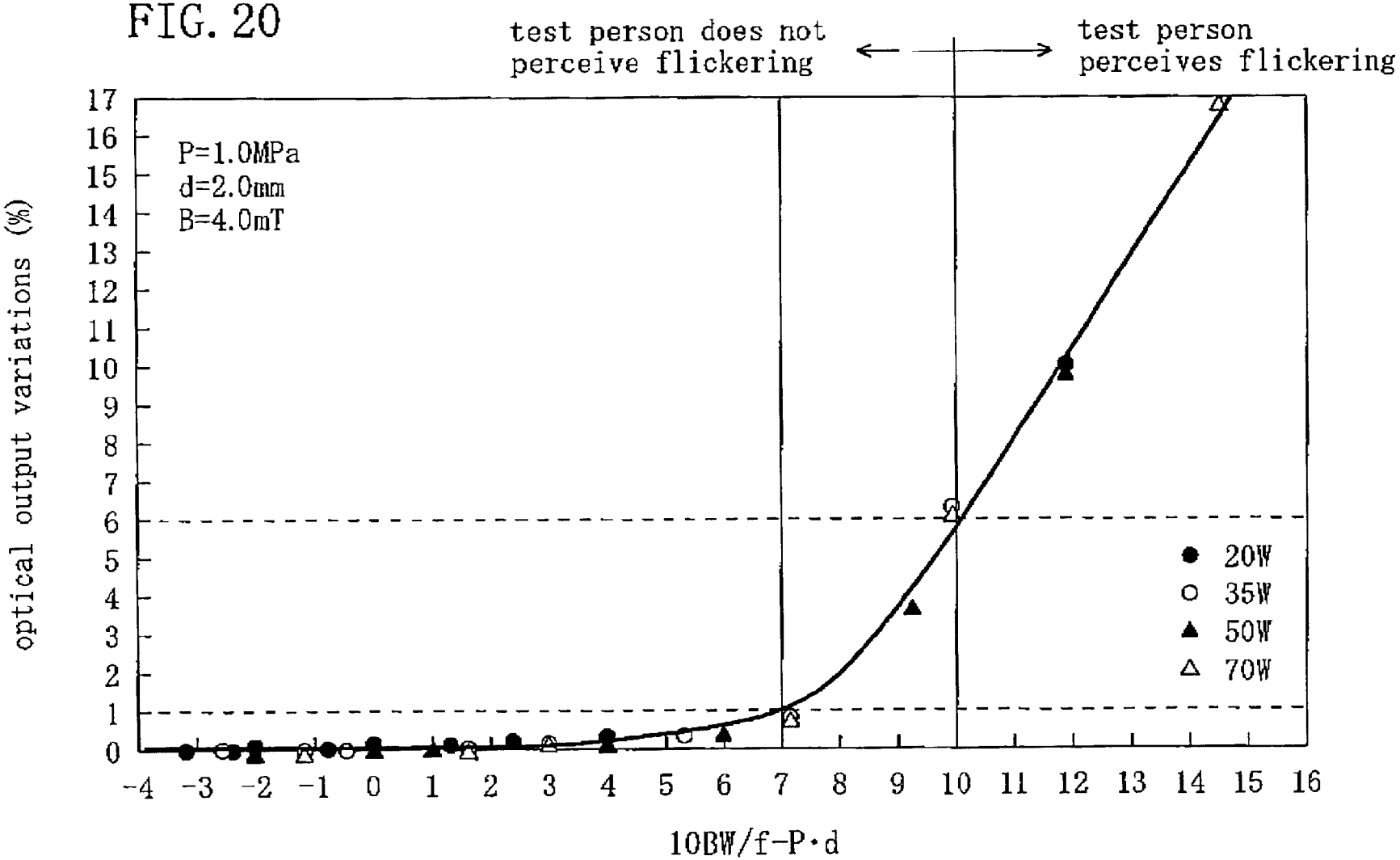
FIG. 20 is a graph illustrating the relationship between 10BW/f–P·d and the variations of the optical output when the distance d between the heads of the electrodes is 2.0 (mm).

FIG. 20 is a graph showing the results of examining the flickering by measuring the variations in the optical output as in FIG. 10. The horizontal axis and the vertical axis in FIG. 20 are the same as in FIG. 10.

As can be seen in FIG. 20, also when the magnetic field was held constant and the distance between the electrode heads was set to 2.0 (mm), the variation of the optical output of the lamp 11 depended on 10BW/f–P·d, as in Embodiment 1. When 10BW/f–P·d exceeds 7, the variation of the optical output nearly exceeds 1(%), reaching a level for which it can be said that variation occurs. When 10BW/f–P·d exceeds 10, the variation of the optical output nearly exceeds 6(%). In this situation, the test person perceived flickering.

Therefore, by setting 10BW/f–P·d within a range that does not exceed 10, it is possible to realize a mercury-free high-intensity discharge lamp, with which a test person does not perceive flickering. Setting 10BW/f–P·d within a range that does not exceed 7, it is not only possible to realize a mercury-free high-intensity discharge lamp with which flickering is not perceived, but also one without optical output variations, which is more preferable.

Figure 21:
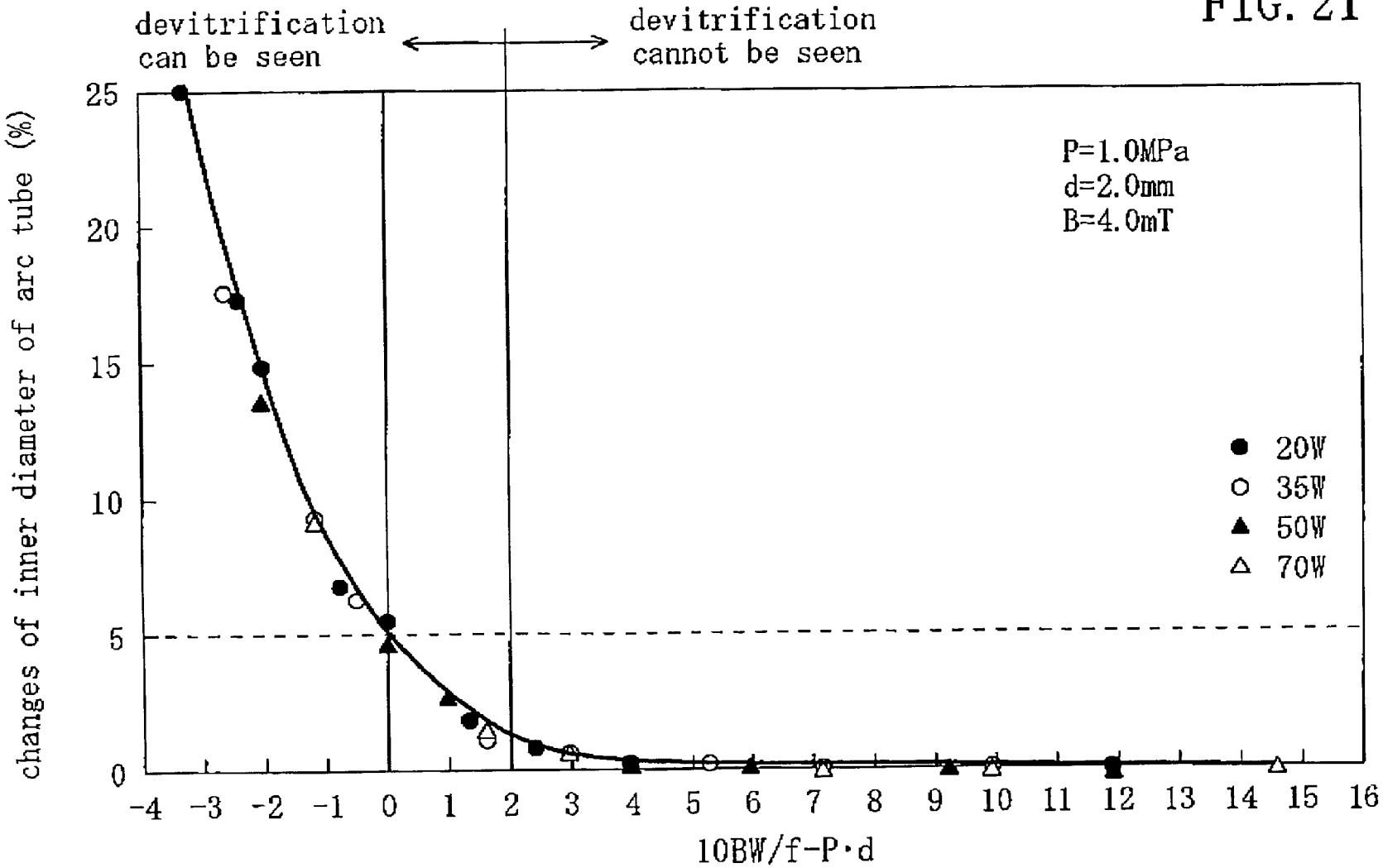
FIG. 21 is a graph illustrating the relationship between 10BW/f–P·d and the rate of change of the inner diameter of the arc tube when the distance d between the heads of the electrodes is 2.0 (mm).

FIG. 21 is a graph showing the results of examining the occurrence of deformations and devitrification in the arc tube by measuring the changes in the internal diameter of the arc tube, as in FIG. 11. The horizontal axis and the vertical axis in FIG. 21 are the same as in FIG. 11.

As can be seen in FIG. 21, also when the magnetic field is held constant and the distance between the electrode heads is set to 2.0 (mm), the change of the internal diameter of the arc tube 1 depends on 10BW/f–P·d, as in Embodiment 1. If the value of 10BW/f–P·d is lower than zero, the change of the internal diameter of the arc tube nearly exceeds 5(%). In this case, it was confirmed that a change in the arc position occurred and another result was that the luminous flux decreased to 70(%) or less of the initial luminous flux and the change of the color temperature exceeded 300(K), and the lifetime characteristics were degraded. Furthermore, although the change of the internal diameter of the arc tube was small, devitrification in the upper portion of the arc tube was observed when the value of 10BW/f–P·d was lower than 2.

Therefore, by setting 10BW/f–P·d within a range that exceeds zero, it is possible to realize a mercury-free high-intensity discharge lamp with little deformations of the arc tube and excellent lifetime characteristics. Setting 10BW/f–P·d within a range that exceeds 2, it is not only possible to realize a mercury-free high-intensity discharge lamp with little deformations of the arc tube, but also one in which devitrification is suppressed and which has even better lifetime characteristics, which is more preferable.

Even though, as in Embodiment 1, devitrification in the arc tube 1 or inner diameter changes of the arc tube 1 could not be acknowledged for mercury-free high-intensity discharge lamp operating apparatuses with an f not greater than 40 (Hz) within the range of 0<10BW/f–P·d<10, blackening was observed at the inner wall of the arc tube. In these lamp operating apparatuses, the lifetime characteristics were degraded, even though the effect of suppressing devitrification and inner diameter changes of the arc tube was attained. Therefore, it is preferable that the operating frequency during steady-state operation exceeds 40 (Hz).

Also within a range of 0<10BW/f–P·d<10, when the distance between the electrode heads was 2.0 (mm), the lamp voltage was about 48(V). In high-intensity discharge lamps with a lamp voltage of less than 60(V), a strong depletion of the electrode heads was seen, even when no devitrification in the arc tube 1 and changes of the inner diameter of the arc tube 1 was seen. This seems to be caused by an increase of the lamp current. Therefore, it is preferable that the distance between the electrode heads is larger than 2.0 (mm).

Furthermore, when making a mercury-free high-intensity discharge lamp operating apparatus 100 with a d of 3 (mm) and evaluating the flickering and the lifetime characteristics, it was found that a mercury-free high-intensity discharge lamp operating apparatus without flickering and with excellent lifetime characteristics can be realized within a range of 0<10BW/f–P·d<10, as in Embodiment 1. However, in that case, the lamp voltage was 62(V). Even though this range is larger than 60(V), it is preferable that d is larger than 3 (mm), because it seems that when taking into account manufacturing variations, lamps with a lamp voltage of less than 60(V) may occur.

Figure 22:
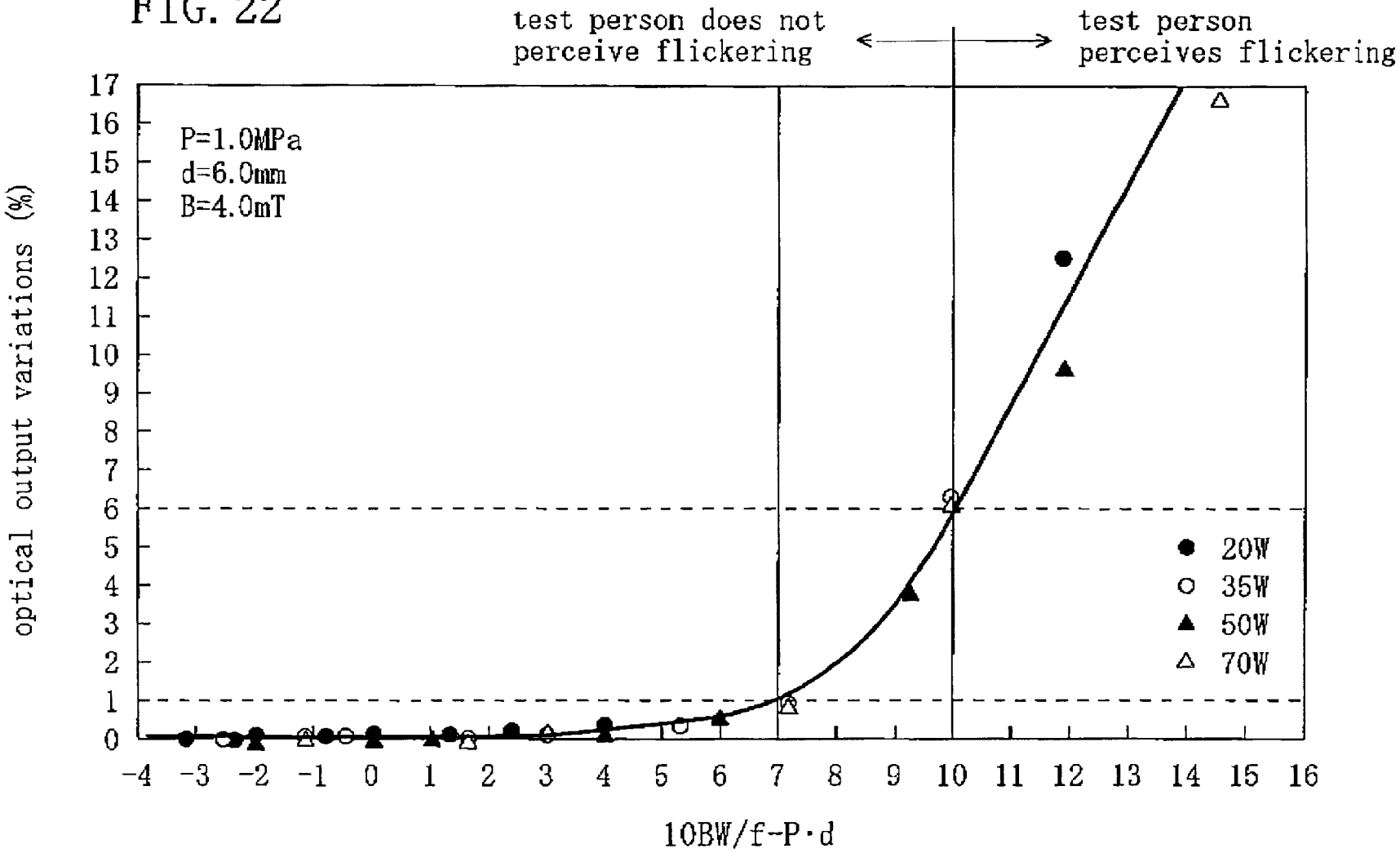
FIG. 22 is a graph illustrating the relationship between 10BW/f–P·d and the variations of the optical output when the distance d between the heads of the electrodes is 6.0 (mm).
Figure 23:
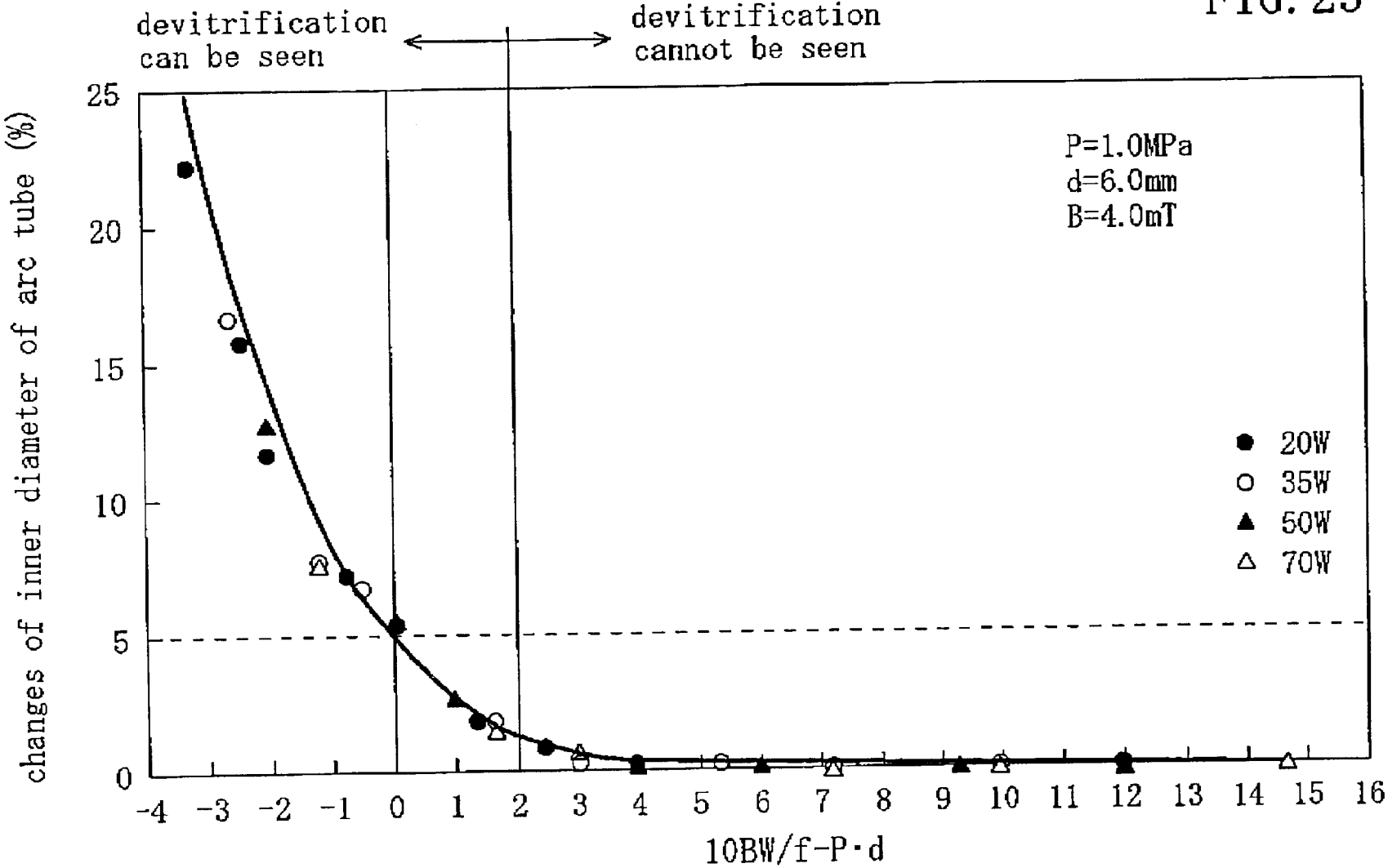
FIG. 23 is a graph illustrating the relationship between 10BW/f–P·d and the rate of change of the inner diameter of the arc tube when the distance d between the heads of the electrodes is 6.0 (mm).

Next, FIG. 22 and FIG. 23 show the results for a configuration in which the distance d between the heads of the pairs to electrodes 3 was set to 6 (mm). Also for the results shown in FIG. 22 and FIG. 23, the flickering and the lifetime characteristics were measured, taking the power w consumed by the lamp 11 during steady-state operation and the operating frequency f during steady-state operation as parameters. The measurement was performed setting the power W to the four levels 20, 35, 50 and 70 (W), and varying f between 30 and 20000 (Hz), such that acoustic resonance effects did not occur. The measurement was performed with a square wave as the waveform of the operating current.

FIG. 22 is a graph showing the result of examining the flickering by measuring the variation in the optical output, as in FIG. 10. The horizontal axis and the vertical axis in FIG. 22 are the same as in FIG. 10.

As can be seen in FIG. 22, also when the magnetic field is held constant and the distance between the electrode heads is set to 6.0 (mm), the variation of the optical output of the lamp 11 depends on 10BW/f–P·d, as in Embodiment 1. When 10BW/f–P·d exceeds 7, the variation of the optical output nearly exceeds 1(%), reaching a level for which it can be said that variation occurs. When 10BW/f–P·d exceeds 10, the variation of the optical output nearly exceeds 6(%). In this situation, the test person perceived flickering.

Therefore, by setting 10BW/f–P·d within a range that does not exceed 10, it is possible to realize a mercury-free high-intensity discharge lamp, with which a test person does not perceive flickering. Setting 10BW/f–P·d within a range that does not exceed 7, it is not only possible to realize a mercury-free high-intensity discharge lamp with which flickering is not perceived, but also one without optical output variations, which is more preferable.

FIG. 23 is a graph showing the results of examining the occurrence of deformations and devitrification in the arc tube by measuring the changes in the internal diameter of the arc tube, as in FIG. 11. The horizontal axis and the vertical axis in FIG. 23 are the same as in FIG. 11.

As can be seen in FIG. 23, also when the magnetic field is held constant and the distance between the electrode heads is set to 6.0 (mm), the change of the internal diameter of the arc tube 1 depends on 10BW/f–P·d, as in Embodiment 1. If the value of 10BW/f–P·d is lower than zero, the change of the internal diameter of the arc tube nearly exceeds 5(%). In this case, it was confirmed a change in the arc position occurred and another result was that the luminous flux decreased to 70(%) or less of the initial luminous flux and the change of the color temperature exceeded 300(K), and that the lifetime characteristics were degraded. Furthermore, although the change of the internal diameter of the arc tube was small, devitrification in the upper portion of the arc tube was observed when the value of 10BW/f–P·d was lower than 2.

Therefore, by setting 10BW/f–P·d within a range that exceeds zero, it is possible to realize a mercury-free high-intensity discharge lamp with little deformations of the arc tube and excellent lifetime characteristics. Setting 10BW/f–P·d within a range that exceeds 2, it is not only possible to realize a mercury-tree high-intensity discharge lamp with little deformations of the arc tube, but also one in which devitrification is suppressed and which has even better lifetime characteristics, which is more preferable.

Furthermore, when making a mercury-free high-intensity discharge lamp operating apparatus 100 in which the distance d between the heads of the pair of electrodes 3 was set to 8 (mm) and evaluating the flickering and the lifetime characteristics, it was found that a mercury-tree high-intensity discharge lamp operating apparatus without flickering and with excellent lifetime characteristics can be realized within a range of 0<10BW/f–P·d<10, as in Embodiment 1. However, this results in a start-up voltage exceeding 30 (kV). A driving circuit generating a start-up voltage in excess of 30 (kV) becomes larger, so that it is preferable that the value for d is lower than 8, that is, it is preferable that the value for P ·d is lower than 8.

Also, with a configuration with a d of 6 mm, a mercury-free high-intensity discharge lamp operating apparatus without flickering and with excellent lifetime characteristics was realized. This resulted in a start-up voltage exceeding 25 (kV). At 25 (kV) or lower, the driving circuit can be made smaller due to the limited start-up voltage, so that it is preferable that the value for d is lower than 6 (mm), that is, it is preferable that the value for P·d is lower than 6.

Embodiment 4

In Embodiment 4, an example of a lighting system including a high-intensity discharge lamp according to the Embodiments 1 to 3 will be described.

Figure 24:
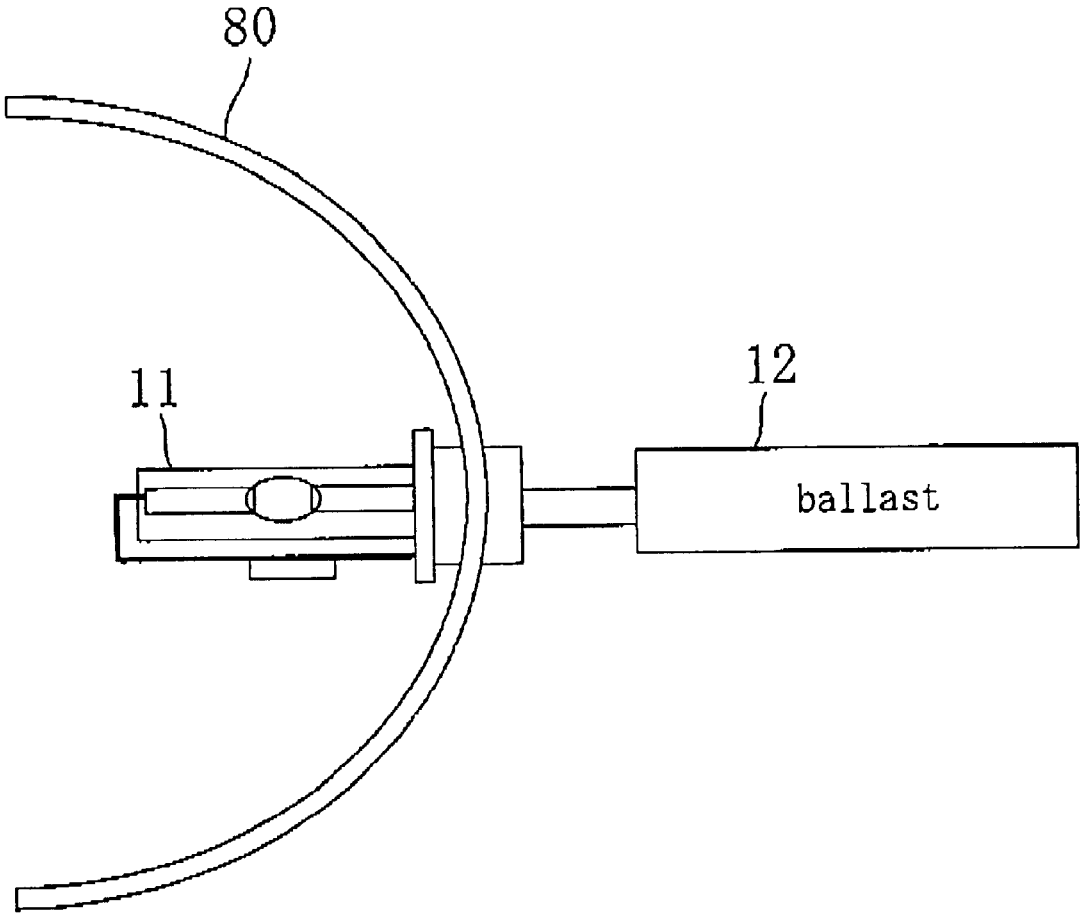
FIG. 24 is a diagram showing the configuration of a mercury-free high-intensity discharge lamp operating apparatus (mirror lamp) according to Embodiment 4.

FIG. 24 schematically shows a configuration of a mirror lamp (lighting system) including a high-intensity discharge lamp 11 according to the previous embodiments, a ballast 12, and a reflecting mirror 80 that reflects light emitted by the lamp 11. The center of the arc of the lamp 11 is arranged on the optical axis of the reflecting mirror 80. The lamp is attached to the reflecting mirror 80 such that a straight line connecting the heads of the two electrodes 3 is oriented in horizontal direction in that situation, the lamp 11 is connected to the ballast 12.

With the configuration shown in FIG. 24, the light from the arc can be projected advantageously, and a mercury-free high-intensity discharge lamp operating apparatus (lighting system) with high efficiency can be realized. Moreover, as described above, the arc position in the high-intensity discharge lamp Can be controlled by adjusting the downward force F2 due to the term (10BW/f) and the upward force F1 due to the term P·d, so that a system can be easily realized, in which the light distribution of the projected light can be varied.

Embodiment 5

Although, as described above, metal halide lamps not containing mercury are desirable in view of environmental issues arising when disposing of waste, among metal halide lamps containing mercury, metal halide lamps containing halides of In (indium) are used suitably. In has excellent light emission properties, and, as shown in ELECTRIC DISCHARGE LAMPS (p. 218, John F. Waymouth), it is known to effect a thickening of the arc, thus stabilizing the arc.

The inventors of the present invention have made a test mercury-free metal halide lamp by taking a Sc—Na mercury-containing metal halide lamp and eliminating the mercury, and found that it was not possible to attain the expected light emission characteristics. Then, the inventors made a test metal halide lamp not containing mercury, which had excellent light emission characteristics and in which In was added, which is known to have the effect of stabilizing the arc. Except for the enclosed material 6, the configuration of this metal halide lamp is the same as that shown in FIG. 1.

Here, the distance d between the electrodes was set to about 4.2 (mm) and the xenon gas pressure at 20° C. was set to 1.4 (MPa). The internal volume of the arc tube 1 was about 0.025 (cc), and the enclosed halide 6 was made of about 0.1 mg of trivalent indium iodide $InI_3$ (mass per unit internal volume of the arc tube: about 4.2 mg/cc), about 0.19 mg of scandium iodide (mass per unit internal volume of the arc tube: about 8.0 mg/cc), and about 0.16 mg sodium iodide (mass per unit internal volume of the arc tube: about 6.4 mg/cc). Needless to say, the arc tube 1 does not contain mercury.

This mercury-free metal halide lamp was operated while orienting it such that a straight line connecting the heads of the electrodes of the lamp was arranged vertically (this is referred to as "vertical operation" in the following). However, adding In did not lead to a stabilization of the arc, and on the contrary, destabilized the arc in this mercury-free metal halide lamp. That is to say, the arc became non-stationary, and the optical output of the lamp became instable. Therefore, it was found that the problem occurred that flickering was perceived.

Next, when the mercury-free metal halide lamp was operated while orienting it such that a straight line connecting the heads of the electrodes of the lamp was arranged horizontally (this is referred to as "horizontal operation" in the following), the arc was stable, contacting the inner surface of the arc tube. However, even though the arc was stable, it contacted the inner surface of the arc tube, and this contact portion expanded and led to breaking of the arc tube. Therefore, when the arc is stable but contacts the inner surface of the arc tube, it is impossible to use the lamp. In order to prevent this, a magnetic field was applied to add a downward force F2 on the arc, according to the insights reached by the inventors of the present invention, and it was tried to operate the lamp without the arc coming into contact with the inner surface of the arc tube, but as in the case of vertical operation, the arc was instable. Thus, the optical output of the lamp was instable and flickering was perceived.

In conventional metal halide lamps containing mercury, this phenomenon cannot occur if In, which has the effect of stabilizing the arc, is enclosed as the luminous metal. However, in metal halide lamps not containing mercury, the arc becomes unstable when In is contained. This means, a phenomenon occurred, that could not be predicted from conventional metal halide lamps including mercury.

The inventors of the present invention were successful in stabilizing a mercury-free metal halide lamp containing In by controlling the upward force (buoyancy) F1 inside the arc tube 1, and realized a mercury-free metal halide lamp containing In with a stabilized arc.

Hereinafter, a mercury-free metal halide lamp according to the present embodiment will be described with reference to FIGS. 25 to 27.

The mercury-free metal halide lamp of the present embodiment has the same configuration as the lamp shown in FIG. 1. The pressure of the enclosed rare gas and the main electrode distance are chosen such that $Pd \leqq 4.6$ was satisfied, wherein d(mm) is the distance between the electrodes and P(MPa) is the pressure of the enclosed gas at 20° C. In this embodiment, the electrode distance d is set to about 4.2 (mm) and the pressure of the enclosed xenon gas at 20° C. is set to 1.4 (MPa). In the present embodiment, auxiliary electrodes for facilitating the lamp operation are not provided, but it is also possible to provide auxiliary electrodes. The configuration of providing auxiliary electrodes is not limited to the present embodiment, and can also be adopted in the above-described Embodiments 1 to 4. Needless to say, the distance d between the electrodes when auxiliary electrodes are provided can be the same as the distance between the main electrodes without auxiliary electrodes.

In the present embodiment, the distance between the heads of the electrodes 3 in the arc tube 1, that is, the distance d between the electrodes is about 4.2 (mm). The internal volume of the arc tube 1 is about 0.025 (cc), and the arc tube 1 contains a halide 6 made of about 0.1 mg of trivalent indium iodide $InI_3$ (mass per unit internal volume of the arc tube: about 4.2 mg/cc), about 0.19 mg of scandium iodide (mass per unit internal volume of the arc tube: about 8.0 mg/cc), and about 0.16 mg of sodium iodide (mass per unit internal volume of the arc tube: about 6.4 mg/cc). Although it is not shown in the drawings, five kinds of test lamps were produced, filling the arc tube 1 with Xe gas of 0.3 MPa (Megapascal), 0.7 MPa, 1.0 MPa, 1.1 MPa and 1.4 MPa at room temperature (20° C.). A current with a square waveform of 150 Hz was supplied to these test lamps, which were vertically operated at 35 W lamp power.

To quantify the instability (flickering) of the arc, the changes of the optical output were observed with a photometer 40, and the flickering was observed on a monitor 70, with the configuration shown in FIG. 9. Both in the this embodiment and the above-described Embodiment 1, the distance between the measurement head 42 and the lamp 11 was set to 32 cm.

Figure 25:
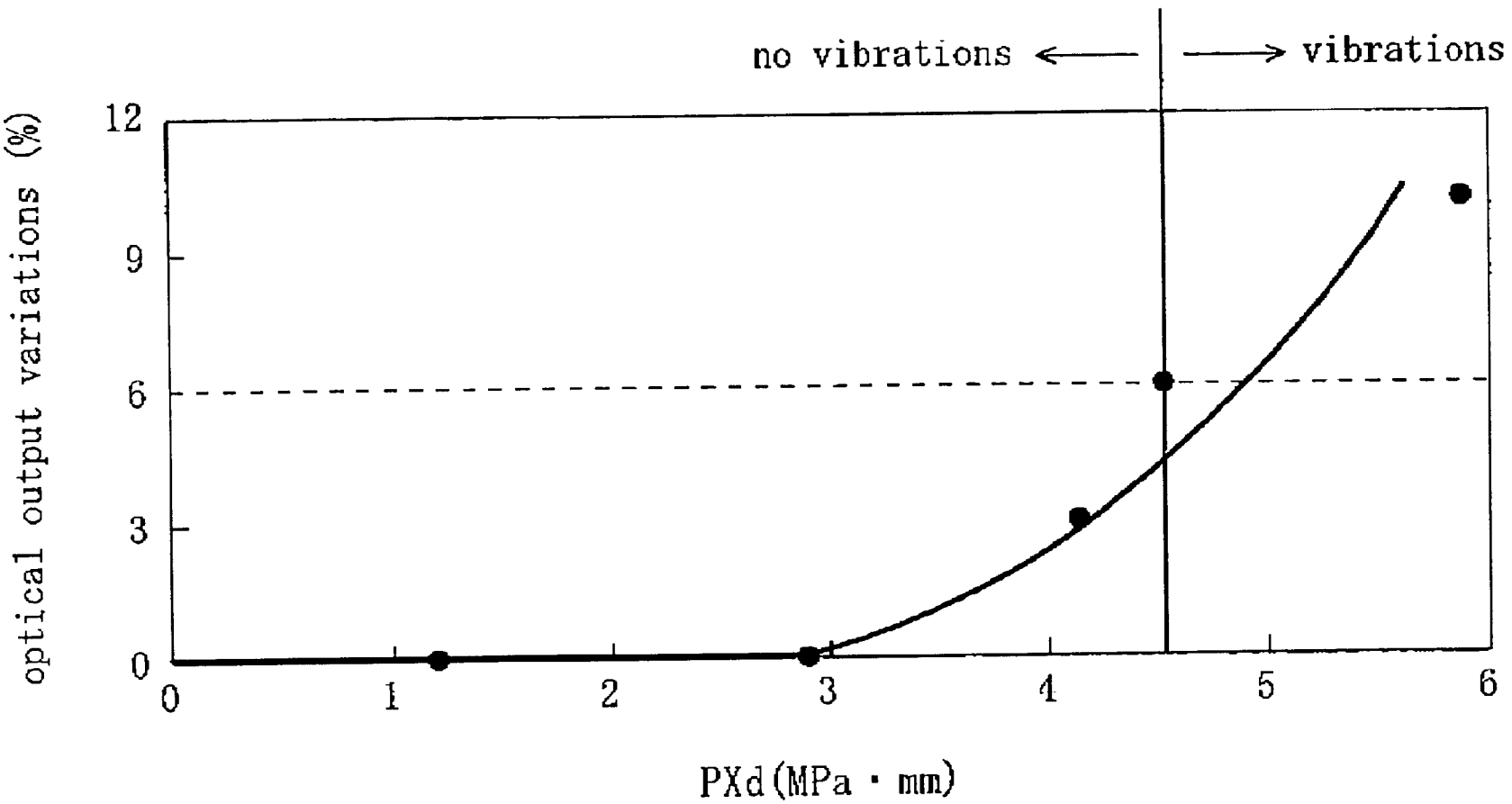
FIG. 25 is a graph showing the relationship between the optical output variations and P×d for Xe pressure when a mercury-free metal halide lamp according to Embodiment 5 is operated vertically at 35 W power.

The results are shown in FIG. 25. In FIG. 25, the horizontal axis marks P×d (MPa·mm), and the vertical axis marks the variation of the optical output. Also in this embodiment, the variation of the optical output is shown as the value (in %) of the difference between the maximum and the minimum of the optical output divided by the average of the optical output.

As can be seen in FIG. 25, the variation of the optical output of the lamp 11 depends on P×d. When F×d becomes larger than 2.94, the optical output starts to vary. When P×d becomes larger than 4.6, the variation of the optical output exceeds 6%. In this situation, the test person perceived this as flickering.

Therefore, by setting P×d to 4.6 or less, it is possible to realize a mercury-free metal halide lamp, with which flickering is not perceived. Setting P×d to 2.94 or less, it is not only possible to achieve a mercury-free metal halide lamp with which flickering is not perceived, but also one without optical output variations, which is more preferable.

Next, the arc instability (flickering) was quantified for lamps 11 with a configuration similar to that of the mercury-free metal halide lamp described above, in which the Xe pressure was set to 1.0 MPa (constant) at room temperature, and the distance d between the electrodes was set to 2.0 mm, 4.2 mm, 4.6 mm and 5.0 mm. Also in these lamps 11, a current with a square waveform of 150 Hz was supplied, and they were vertically operated at 35 W lamp power. The results are shown in FIG. 26. As in FIG. 25, the horizontal axis in FIG. 26 marks P×d and the vertical axis marks the variation of the optical output.

Figure 26:
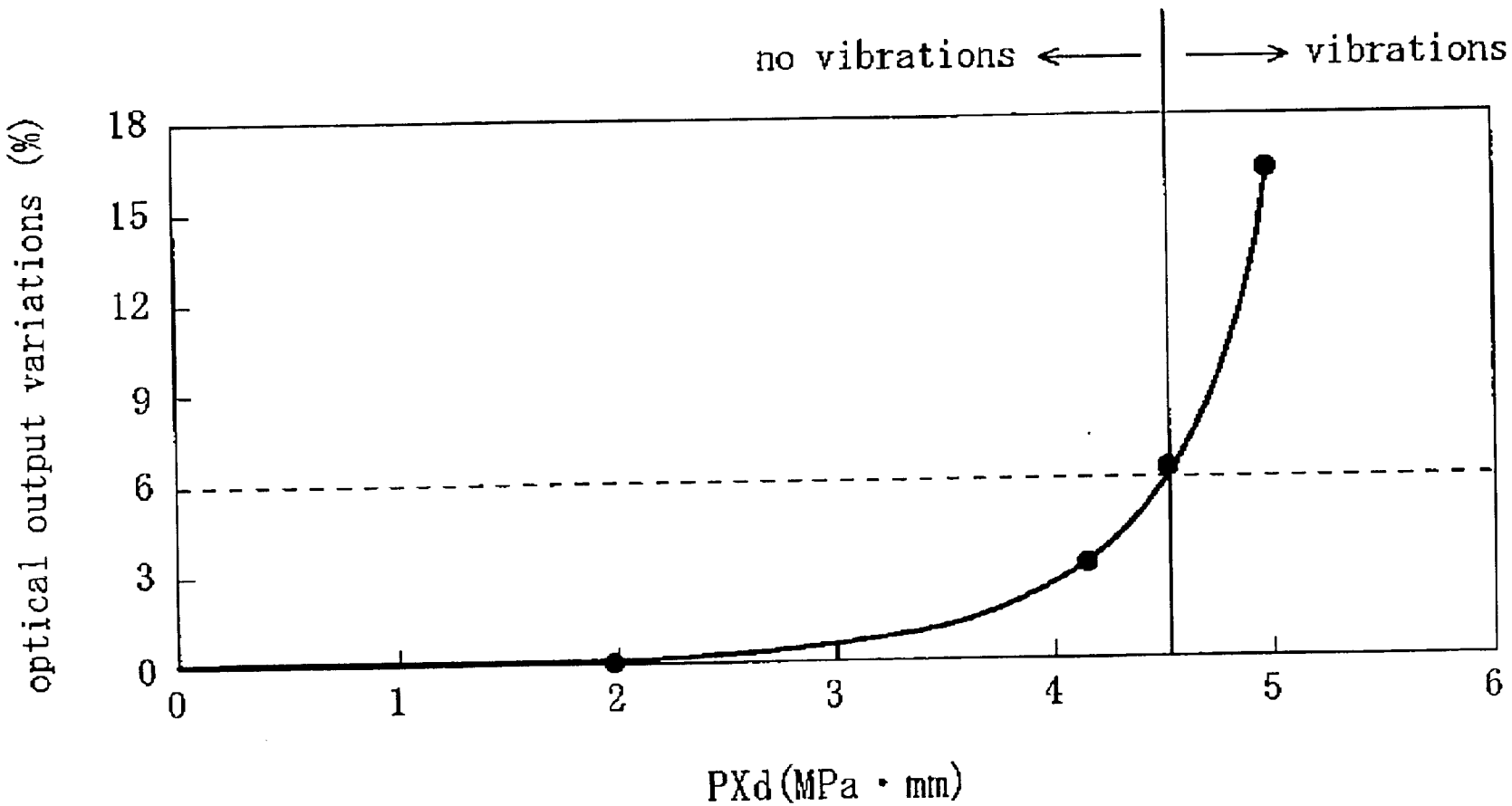
FIG. 26 is a graph showing the relationship between the optical output variations and the distance between the electrodes when a mercury-free metal halide lamp according to Embodiment 5 is operated vertically at 35 W power.

As can be seen in FIG. 26, the variation of the optical output of the lamp 11 depends on P×d. When P×d becomes larger than 4.6, the variation of the optical output exceeded 6%, and the variation of the optical output was about 6 to 10 Hz. In this situation, the test person perceived this as flickering.

Therefore, by setting P×d to 4.6 or less, it is possible to realize a mercury-free metal halide lamp, with which flickering is not perceived. From the above, it can be seen that setting the pressure P(MPa) of the rare gas (Xe) and the distance d(mm) between the electrodes such that Pd≦4.6, it is possible to realize a mercury-free metal halide lamp containing In with which flickering is not perceived.

Although overlapping somewhat with the explanations of the foregoing embodiments, the following describes the principle of arc curving and the conclusions made by the inventors of the present invention.

Usually, when operating metal halide lamps, the arc curves upward due to the buoyancy behavior caused by the temperature distribution arising inside the arc tube. Thus, the inventors of the present invention wondered whether the flickering (arc instability) during the operation of metal halide lamps not containing mercury is affected by the extent of the buoyancy. However, the buoyancy acting on the arc does not only depend on the temperature distribution, and it seems to be necessary to take into account the relationship between the pressure of the rare gas enclosed in the arc tube and the distance between the electrodes.

Figure 27:
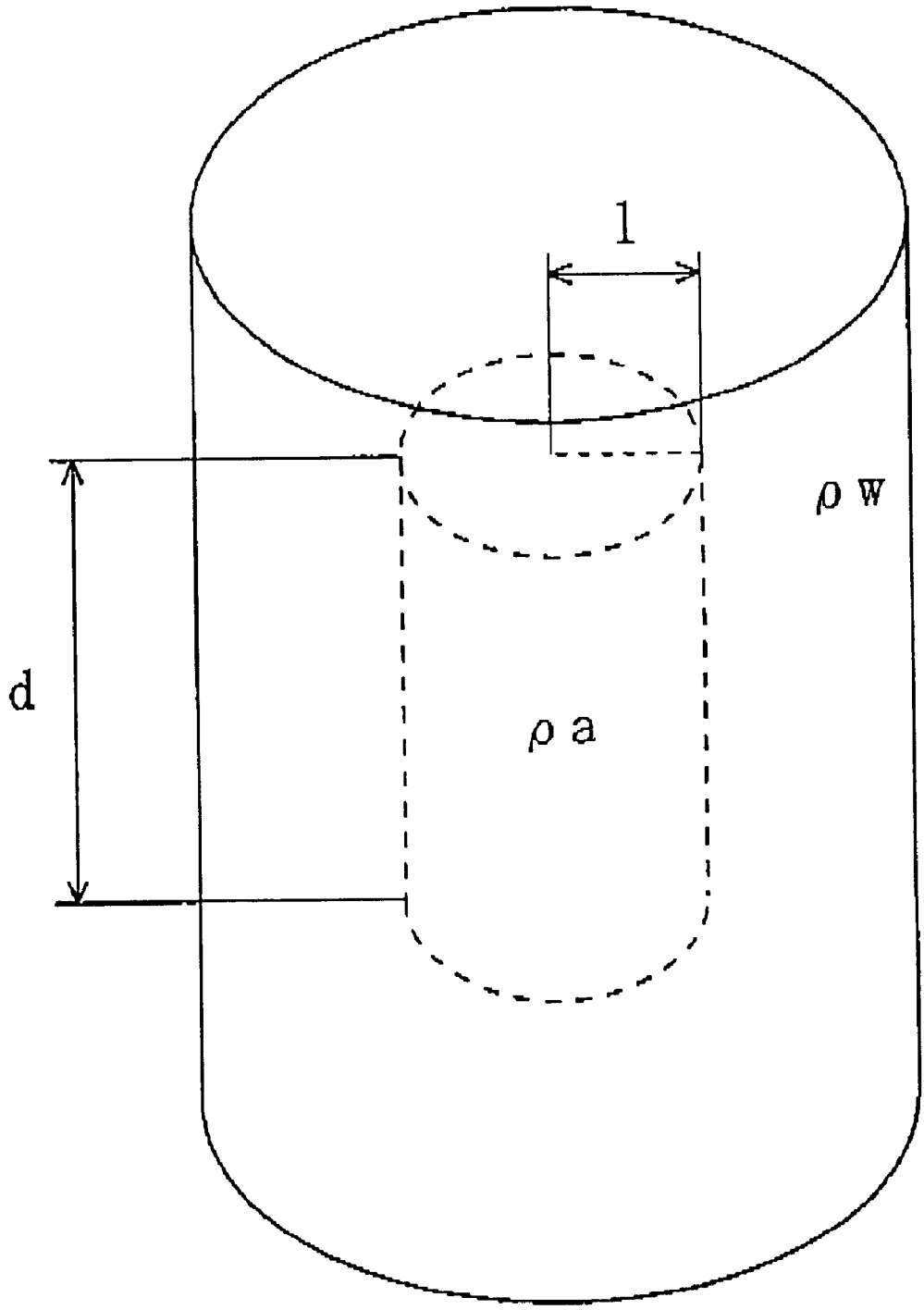
FIG. 27 shows a model for determining the relation between the buoyancy, the gas density and the arc length.

Thus, the model shown in FIG. 27 was developed. Below, the equation relating the buoyancy on the arc, the gas density and the arc length to one another is determined.

The buoyancy F acting on the arc is $$F_1=\pi l^2 d(\rho_w-\rho_a)g \qquad \text{Equation 8}$$

(In Equation 8, $\rho_w$: gas density near the walls of the tube, $p_a$: gas density in the arc, l: effective radius of the arc, g: gravitational force, d: arc length)

Next, assuming that $T_a$(constant) is the gas temperature of the arc and $T_w$ (constant) is the gas temperature near the walls of the tube, Equation 8 can be transformed to:

$$F_1=\pi l^2 d\rho_a\,(T_w-T_a)/T_a\,g \qquad \text{Equation 9}$$

In this embodiment, $\rho_w$ was changed by a factor of about 5. Therefore, the change of the term $(T_w-T_a)/T_a$ can be ignored, because it is small. Thus, the relationship $$F_1\,\rho_a d \qquad \text{Equation 10}$$

follows from Equation 9. $\rho_a$ can be regarded as the gas pressure and d can be regarded as the distance between the electrodes. Therefore, from the proportional expression of Equation 10 and from the experimental results, it can be seen that the arc becomes instable when the buoyancy (P×d) becomes large. Thus, it is possible to realize a mercury-free metal halide lamp for which flickering cannot be perceived by setting the P×d of the lamp within the range at which the arc does not become instable.

Figure 28:
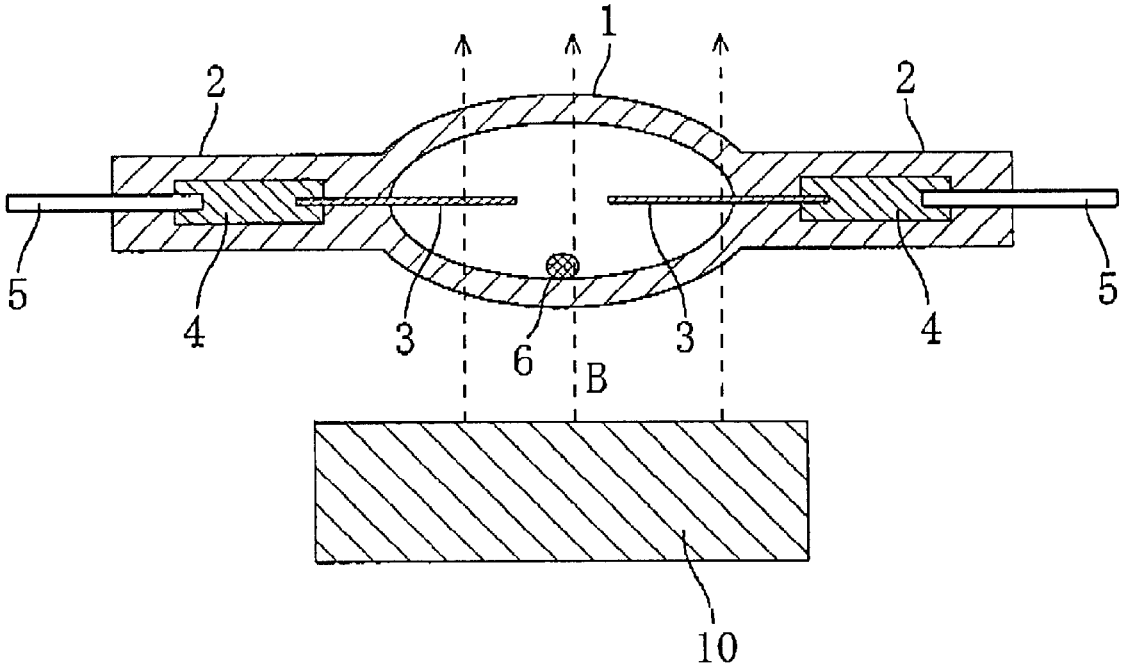
FIG. 28 is a cross-sectional view schematically illustrating another configuration of a mercury-free metal halide lamp according to Embodiment 5.

Next, another configuration according to the present embodiment will be described. FIG. 28 shows a mercury-free metal halide lamp with this configuration. The mercury-free metal halide lamp shown in FIG. 28 is different from the foregoing configuration in that it is horizontally operated and a magnetic field is applied with a permanent magnet 10.

As shown in FIG. 28, the permanent magnet 10 is arranged such that magnetic field B at the portion between the electrode heads is oriented in vertical direction. The strength of the electric field between the electrode heads is 5.0 to 10.0 (mT), and the distance d between the electrodes is 4.6 mm. Although it is not shown in the drawings, test lamps were made for which the Xe pressure inside the arc tube 1 was set to 1.0 (MPa) and 1.4 (MPa). A current with a square waveform of 150 Hz was supplied to the resulting tubes, and the lamps were operated horizontally at 35 W lamp power.

To quantify the instability (flickering) of the arc, the changes of the optical output were observed with a photometer 40, and the flickering was observed on a monitor 70, with the configuration shown in FIG. 9. As the result, it was found that the variation of the optical output depends on P×d, and when P×d becomes larger than 4.6, the variation of the optical output exceeds 6%. In this case, the test person perceived this as flickering, therefore, by setting P×d to 4.6 or less, it is possible to realize a mercury-free metal halide lamp, with which flickering is not perceived.

Thus, setting the pressure P(MPa) of the rare gas (Xe) and the distance d(mm) between the electrodes such that Pd≦4.6, it is possible both for vertical operation and for horizontal operation to realize a mercury-free metal halide lamp with which flickering is not perceived.

When the mercury-free metal halide lamp of the present embodiment is used for a vehicle headlight, then it is desired that the light is instantly on, directly after turning it on, and since the light emission directly after turning on the lamp mainly depends on the rare gas (Xe), it is preferable that the Xe pressure P(MPa) is at least 0.3 (MPa). It is even more preferable that it is at least 0.5 (MPa).

Furthermore, when used as a vehicle headlight, the lamp pressure is proportional to the arc length d(mm), so that when the arc length is too short, it is sometimes not possible to attain a suitable arc pressure, such as 60 to 70V. Therefore, it is preferable that the arc length d is at least 2 mm, more preferably at least 3 mm.

As described also for Embodiment 1, the values given for the pressure of the xenon gas, the distance between the electrodes, as well as the internal volume of the arc tube 1 and the amounts of scandium iodide and sodium iodide etc. given for the present embodiment are only examples. Thus, the internal volume of the arc tube 1 for example is not limited to 0.025 cc, and the amount of scandium iodide is not limited to 0.19 mg. Also, xenon gas was enclosed in the arc tube 1 for the purpose of aiding start-up, but considering use of the lamp in a vehicle headlight, xenon gas is only suitable as a rare gas, and it is also possible to include other rare gases, such as argon gas for example, besides the xenon gas. Similarly, the lamp power is not limited to 35 W.

Also the mercury-free metal halide lamp of the present invention can be devised as a mirror lamp as shown in Embodiment 4. Furthermore, the lamps shown in the Embodiments 1 to 5 can be used not only as vehicle headlights, but of course also for other applications, such as general lighting. For example, the lamps can be used as the light source in image projection systems, such as projectors using liquid crystals or DMD. Moreover, the lamps can also be used for sports stadiums or floodlights illuminating road signs.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A mercury-free high-intensity discharge lamp operating apparatus comprising:

a horizontally operated high-intensity discharge lamp including an arc tube in which a luminous material is enclosed and a pair of electrodes are arranged in the arc tube;

a ballast including an alternating current generation means for supplying alternating current to the pair of electrodes; and a magnetic field application means for applying in substantially vertical direction a magnetic field having a component that is substantially perpendicular to a straight line connecting heads of the pair of electrodes;

wherein mercury is not included as the luminous material in the arc tube; and satisfying the relationship $$0<(100BW/f)-P_0d<100$$

wherein B(mT) is the magnetic field applied to a center between the heads of the pair of electrodes, d(mm) is a distance between the heads of the pair of electrodes, $P_0$(MPa) is a pressure inside the arc tube during steady-state operation, W(W) is a power consumed during steady-state operation and f(Hz) is a steady-state frequency during steady-state operation.

2. A mercury-free high-intensity discharge lamp operating apparatus comprising:

a horizontally operated high-intensity discharge lamp including an arc tube in which a luminous material is enclosed and a pair of electrodes are arranged in the arc tube;

a ballast including an alternating current generation means for supplying alternating current to the pair of electrodes; and a magnetic field application means for applying in substantially vertical direction a magnetic field having a component that is substantially perpendicular to a straight line connecting the heads of said pair of electrodes;

wherein mercury is not included as the luminous material in the arc tube, and at least a rare gas is included in the arc tube; and satisfying the relationship $$0<(10BW/f)-Pd<10$$

wherein B(mT) is the magnetic field applied to a center between the heads of the pair of electrodes, d(mm) is a distance between the heads of the pair of electrodes, P(MPa) is a pressure of the enclosed rare gas at 20° C., W(W) is a power consumed during steady-state operation, and f(Hz) is a steady-state frequency during steady-state operation.

3. The mercury-free high-intensity discharge lamp operating apparatus according to claim 1 or 2, wherein the operating frequency f during steady-state operation is in a range of 40 (Hz)<f.

4. The mercury-free high-intensity discharge lamp operating apparatus according to claim 1 or 2, wherein the magnetic field B is in a range of B<500 (mT).

5. The mercury-free high-intensity discharge lamp operating apparatus according to claim 1 or 2, wherein the distance d between the heads of the electrodes is in a range of 2<d(mm).

6. The mercury-free high-intensity discharge lamp operating apparatus according to claim 1 or 2, wherein the high-intensity discharge lamp is a metal halide lamp including at least indium halide as the luminous material in the arc tube.

7. The mercury-free high-intensity discharge lamp operating apparatus according to claim 1 or 2, further comprising a reflecting mirror for reflecting light emitted by the high-intensity discharge lamp;

wherein a center of an arc of the mercury-free high-intensity discharge lamp is arranged on an optical axis of the reflecting mirror.

8. The mercury-free high-intensity discharge lamp operating apparatus according to claim 2, wherein the pressure P of the enclosed rare gas is in a range of 0.1 (MPa)<P<2.5 (MPa).

9. The mercury-free high-intensity discharge lamp operating apparatus according to claim 2, wherein the pressure P and the distance d satisfy the relationship P·d<8.

10. The mercury-free high-intensity discharge lamp operating apparatus according to claim 9, wherein the pressure P and the distance d satisfy the relationship Pd≦4.6.

11. A mercury-free metal halide lamp, comprising an arc tube in which a luminous material is enclosed and a pair of electrode are arranged in the arc tube;

wherein at least an indium halide serving as the luminous material and a rare gas are contained in the arc tube; and mercury is not included as the luminous material in the arc tube;

satisfying Pd≦4.6, wherein d(mm) is a distance between the heads of the pair of electrodes, and P(MPa) is a pressure of the enclosed rare gas at room temperature; and further comprising a magnetic field application means for applying a magnetic field having a component that is substantially perpendicular to a straight line connecting the heads of the pair of electrodes, thereby suppressing arc curving.

12. The mercury-free metal halide lamp according to claim 11, wherein the pressure P of the enclosed rare gas is at least 0.3 (MPa) at room temperature.

13. The mercury-free metal halide lamp according to claim 11, wherein the distance d is at least 2 (mm).

14. The mercury-free metal halide lamp according to claim 11, wherein the metal halide lamp is operated in a perpendicular direction.

15. The mercury-free metal halide lamp according to claim 11, wherein the metal halide lamp is operated in a horizontal direction.

16. The mercury-free metal halide lamp according to claim 11, wherein the metal halide lamp is of an alternating current lighting type where an alternating current is supplied to the pair of electrodes.

17. The mercury-free metal halide lamp according to claim 11, wherein the rare gas is Xe (xenon).

18. The mercury-free metal halide lamp according to claim 11, further comprising a reflecting mirror for reflecting light emitted by the metal halide lamp;

wherein a center of an arc of the mercury-free metal halide lamp is arranged on an optical axis of the reflecting mirror.

19. The mercury-free metal halide lamp according to claim 11, wherein a scandium halide, a sodium halide, and a thallium halide are contained as the luminous material in the arc tube.

20. The mercury-free metal halide lamp according to claim 19, wherein a halogen constituting the halides is at least one selected from the group consisting of iodine and bromine.

* * * * *